US011075436B2

(12) United States Patent
Vynohradov et al.

(10) Patent No.: US 11,075,436 B2
(45) Date of Patent: Jul. 27, 2021

(54) RADIOFREQUENCY RF ROTATING JOINT FOR ROTARY RF WAVE-GUIDING DEVICE AND ROTARY RF DEVICE INCLUDING SUCH A JOINT

(71) Applicants: THALES, Courbevoie (FR); CENTRE NATIONAL D'ETUDES SPATIALES, Paris (FR)

(72) Inventors: Dimitri Vynohradov, Toulouse (FR); Jérôme Brossier, Fonsorbes (FR); Benjamin Monteillet, Toulouse (FR); Jérôme Lorenzo, La Salvetat Saint Gilles (FR); Nicolas Ferrando, Tournefeuille (FR)

(73) Assignees: THALES, Courbevoie (FR); CENTRE NATIONAL D'ETUDES SPATIALES, Paris (FR)

( * ) Notice: Subject to any disclaimer, the term of this patent is extended or adjusted under 35 U.S.C. 154(b) by 0 days.

(21) Appl. No.: 16/696,931

(22) Filed: Nov. 26, 2019

(65) Prior Publication Data

US 2020/0194861 A1 Jun. 18, 2020

(30) Foreign Application Priority Data

Dec. 18, 2018 (FR) ..... 1873020

(51) Int. Cl.
*H01P 3/123* (2006.01)
*H01P 1/06* (2006.01)
(Continued)

(52) U.S. Cl.
CPC ..... *H01P 3/123* (2013.01); *H01P 1/065* (2013.01); *H01P 1/182* (2013.01); *H01P 5/182* (2013.01);
(Continued)

(58) Field of Classification Search
CPC ..... H01P 3/123; H01P 1/065; H01P 1/182; H01P 5/182; H01Q 13/065; H01Q 21/064
(Continued)

(56) References Cited

FOREIGN PATENT DOCUMENTS

EP 2 343 774 A1 7/2011
EP 3 147 994 A1 3/2017
(Continued)

OTHER PUBLICATIONS

Rajo-Iglesias, et al., "Groove Gap Waveguide: A Rectangular Waveguide Between Contactless Metal Plates Enabled by Parallel-Plate Cut-Off", Proceedings of the Fourth European Conference on Antennas and Propagation, Jul. 8, 2010.
(Continued)

*Primary Examiner* — Robert J Pascal
*Assistant Examiner* — Kimberly E Glenn
(74) *Attorney, Agent, or Firm* — BakerHostetler

(57) ABSTRACT

An RF joint rotating about an axis of rotation (Z) includes a number N, greater than or equal to 1, of RF transmission channels, a first, internal surface of symmetry of revolution about the axis (Z) and of RF transmission having a first, internal radius r1, and a second, external surface of symmetry of revolution about the axis (Z) and of RF transmission having a second, external radius r2, strictly less than the first, internal radius r1. The first and second RF transmission surfaces facing one another and rotationally mobile about the axis (Z) are configured through the first and second radii r1, r2, the geometry of the first and second RF access ports, and the geometry of the first and second RF containment and guidance means, such that: each RF transmission channel Vi, i varying from 1 to N, comprises a first RF rotating waveguide, and the N first RF rotating waveguides are distributed angularly over a predetermined number NC, greater than or equal to 1 and less than or equal to N, of
(Continued)

sections of surfaces of revolution about the axis (Z) of the second RF transmission surface, each of the NC sections being situated along the longitudinal axis of symmetry (Z) at a predetermined different level L1(*k*).

20 Claims, 13 Drawing Sheets

(51) Int. Cl.
*H01P 1/18* (2006.01)
*H01P 5/18* (2006.01)
*H01Q 13/06* (2006.01)
*H01Q 21/06* (2006.01)

(52) U.S. Cl.
CPC ..... *H01Q 13/065* (2013.01); *H01Q 21/064* (2013.01)

(58) Field of Classification Search
USPC ..... 333/239
See application file for complete search history.

(56) References Cited

FOREIGN PATENT DOCUMENTS

| | | | |
|---|---|---|---|
| FR | 3 029 018 | A1 | 5/2016 |
| FR | 3 071 363 | A1 | 3/2019 |
| WO | 2017/131099 | A1 | 8/2017 |

OTHER PUBLICATIONS

Kirino, et al., "A 76 GHz Multi-Layered Phased Array Antenna Using a Non-Metal Contact Metamaterial Waveguide", IEEE Transactions on Antennas and Propagation, vol. 60, Issue 2, pp. 840-853, Feb. 1, 2012.

Rambabu, et al., "Compact single-channel rotary joint using ridged waveguide sections for phase adjustment", IEEE Transactions on Microwave Theory and Techniques, vol. 51, Issue 8, pp. 1982-1986, Aug. 1, 2003.

[Fig. 1A]
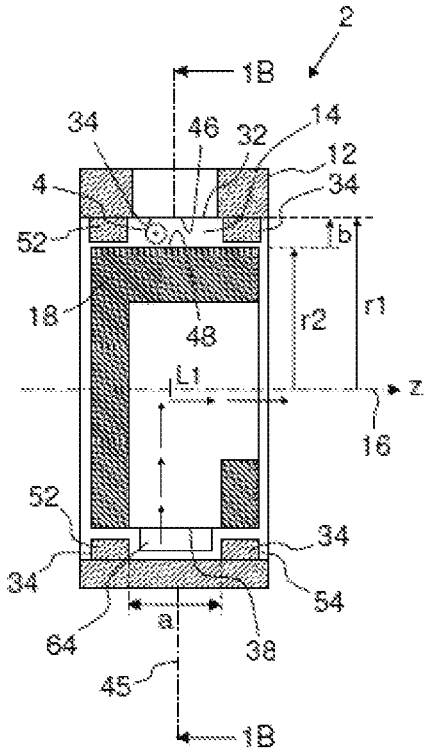

[Fig. 1B]
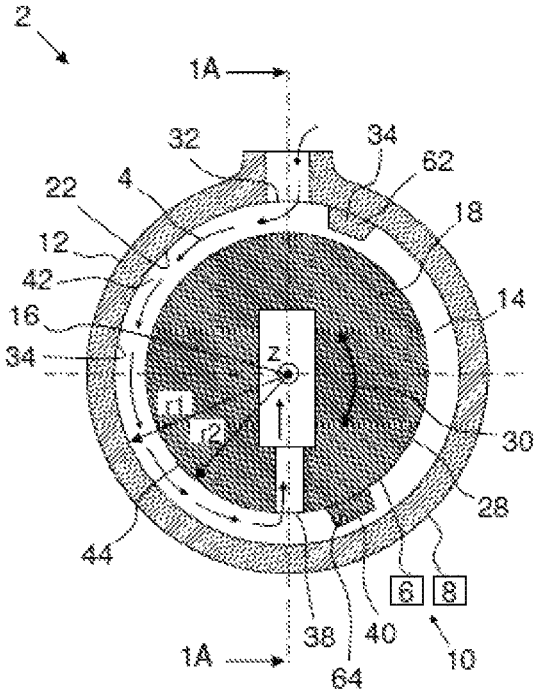

[Fig. 2A]
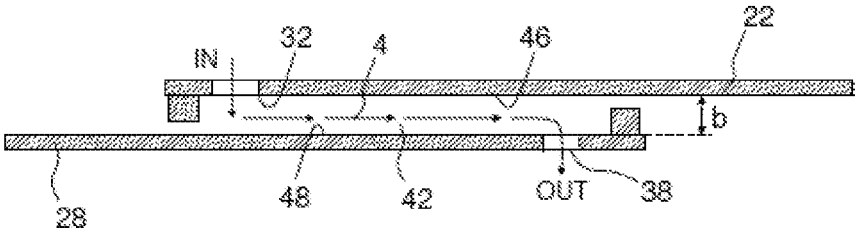
[Fig. 2B]
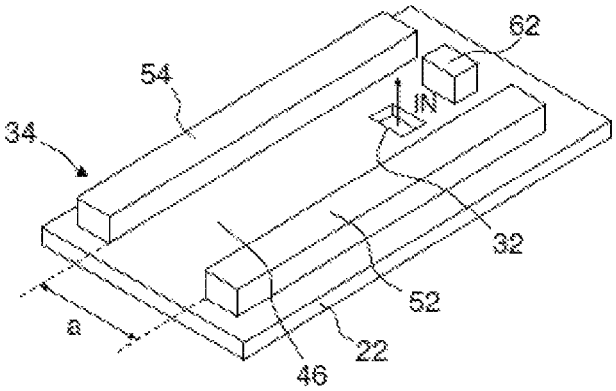
[Fig. 2C]
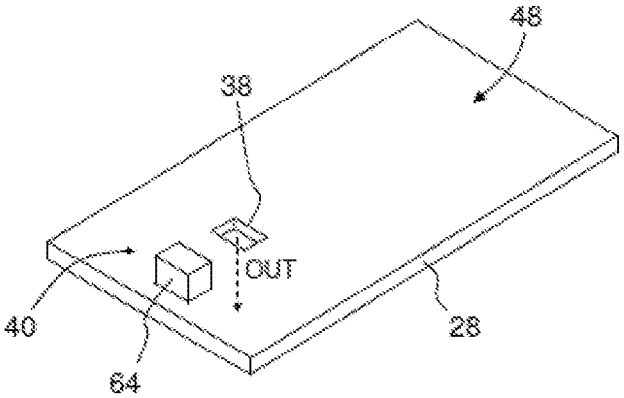

[Fig. 3]
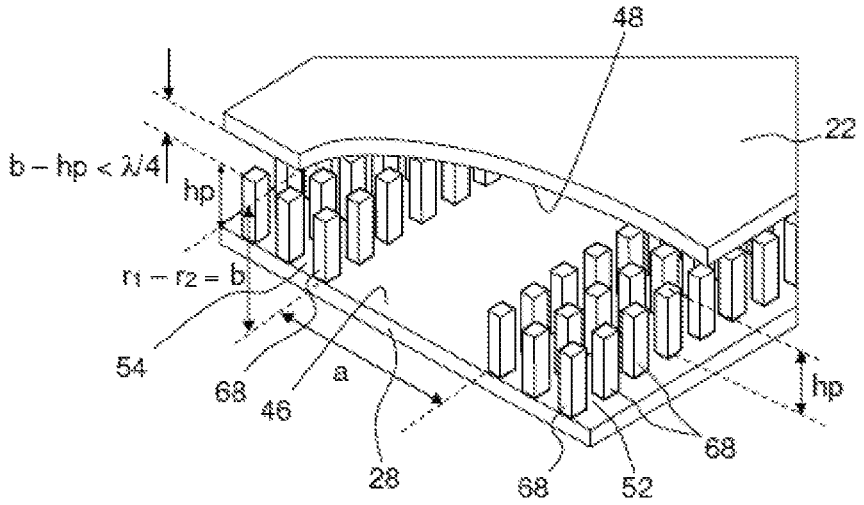
[Fig. 4 A]
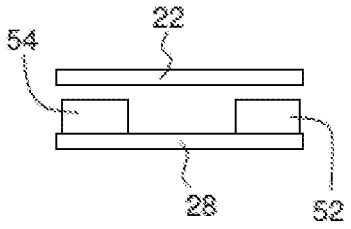
[Fig. 4B]
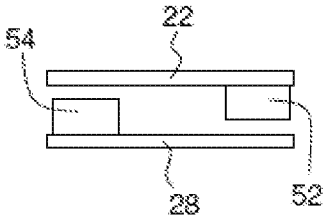

[Fig. 4C]
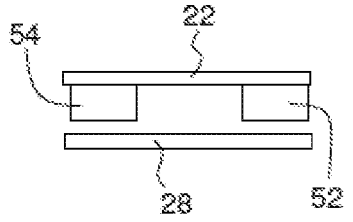
[Fig. 5]
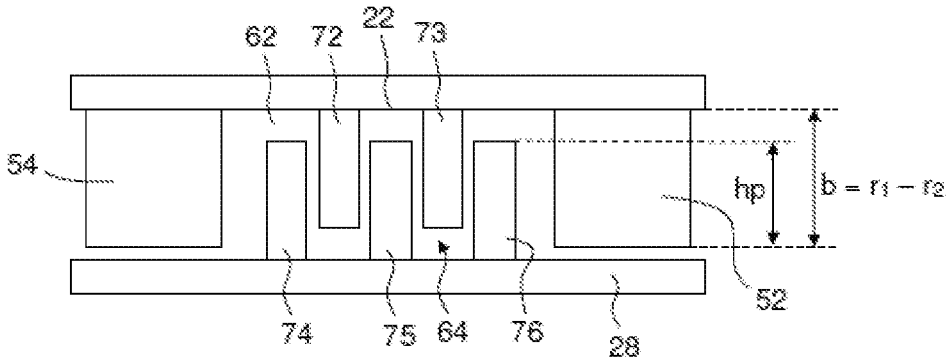
[Fig. 6 A]
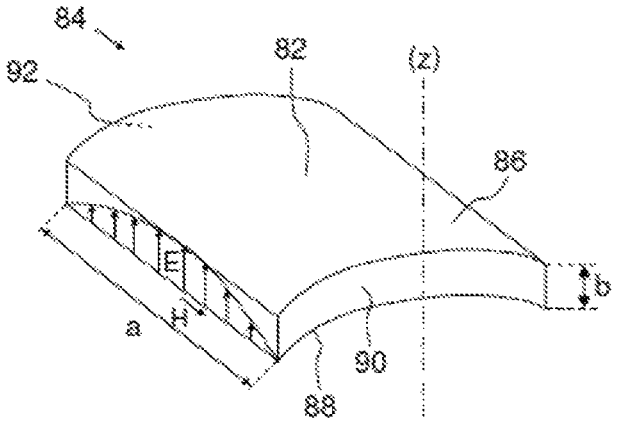
Plane H curvature

[Fig. 6B]
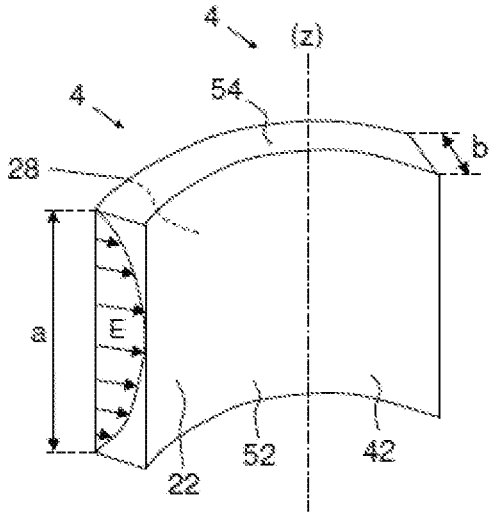
Plane E curvature
[Fig. 7 A]
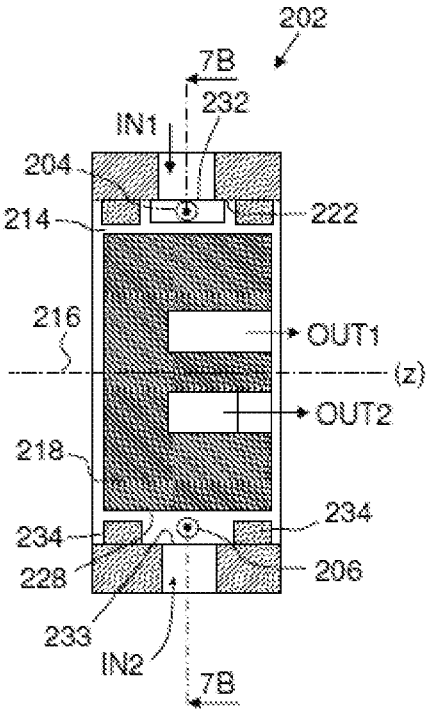

[Fig. 7B]
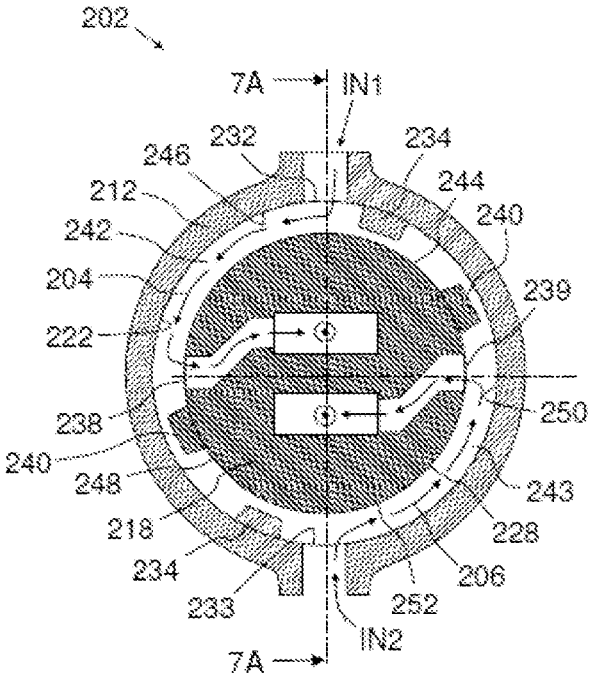
[Fig. 8A]
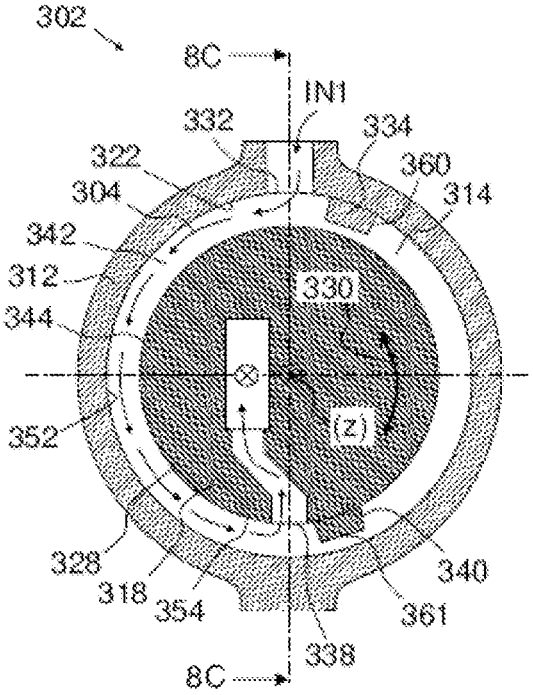

[Fig. 8B]
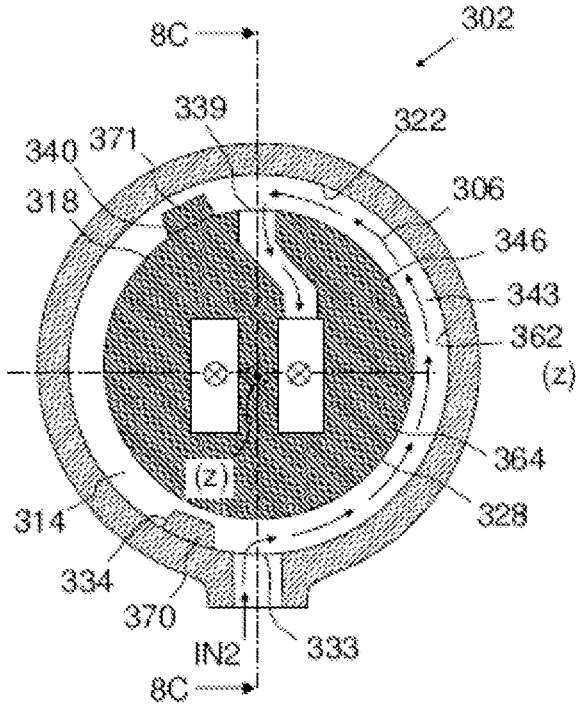
[Fig. 8C]
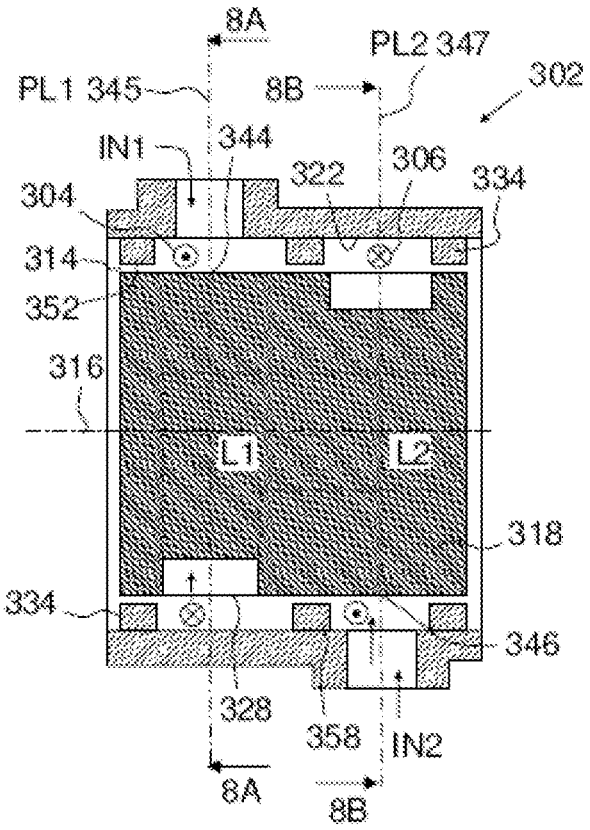

[Fig. 9]
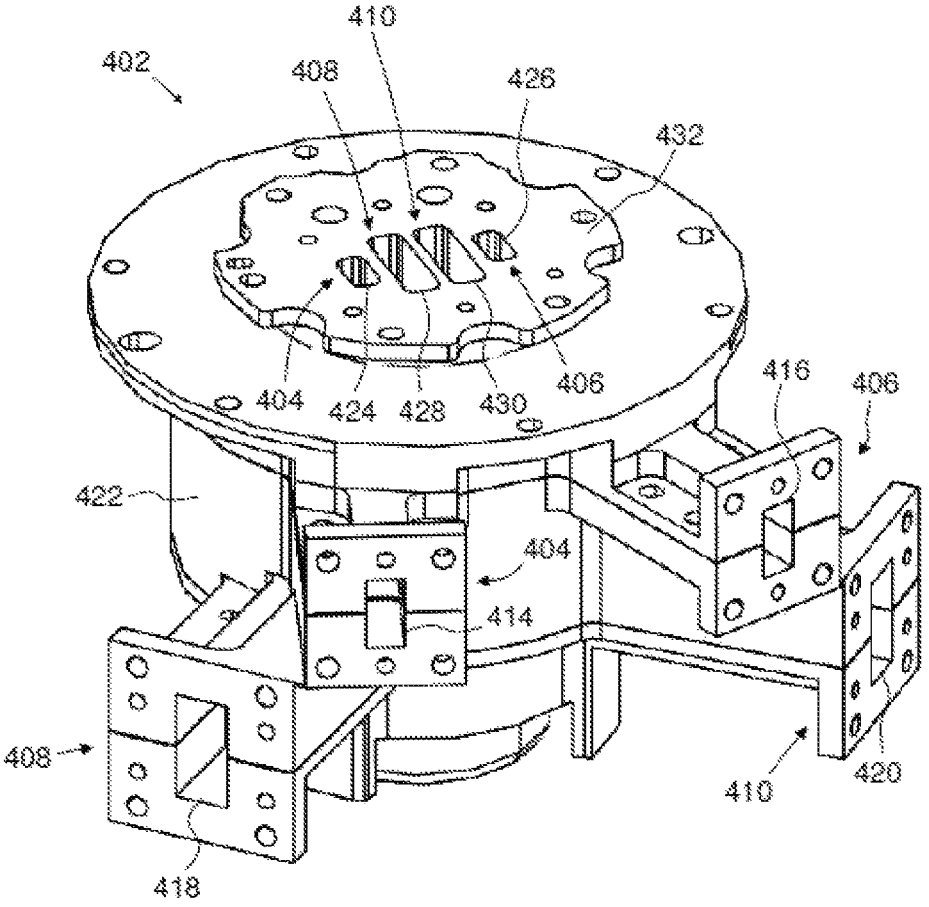

[Fig. 10]
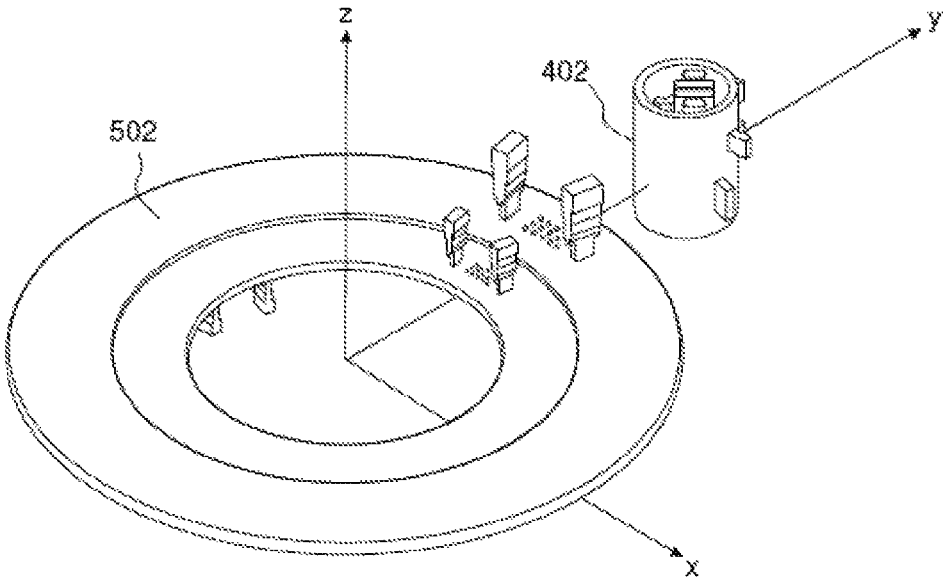
[Fig. 11 A]
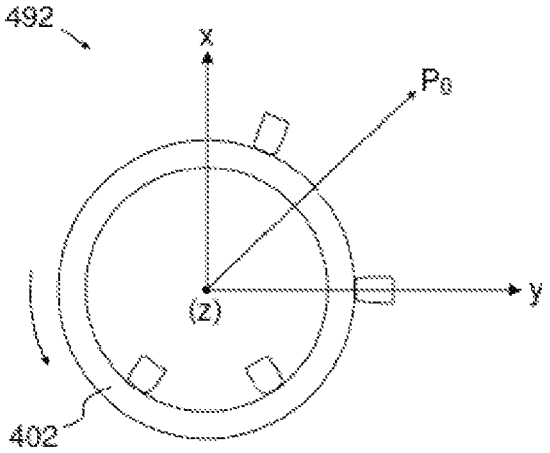

[Fig. 11B]
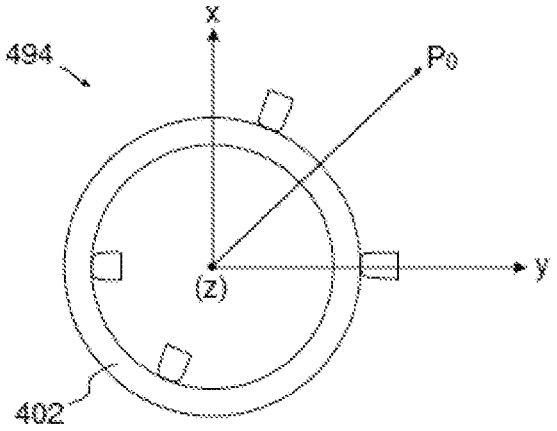
[Fig. 11C]
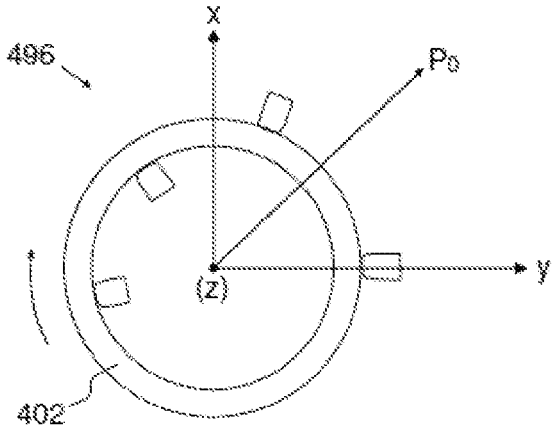

[Fig. 12A]
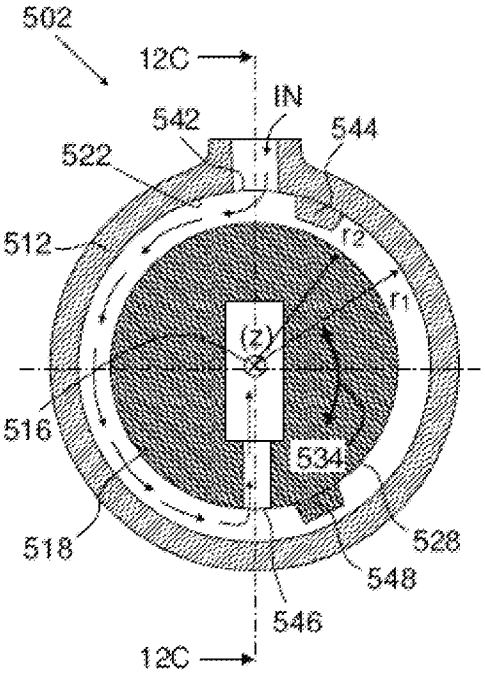
[Fig. 12B]
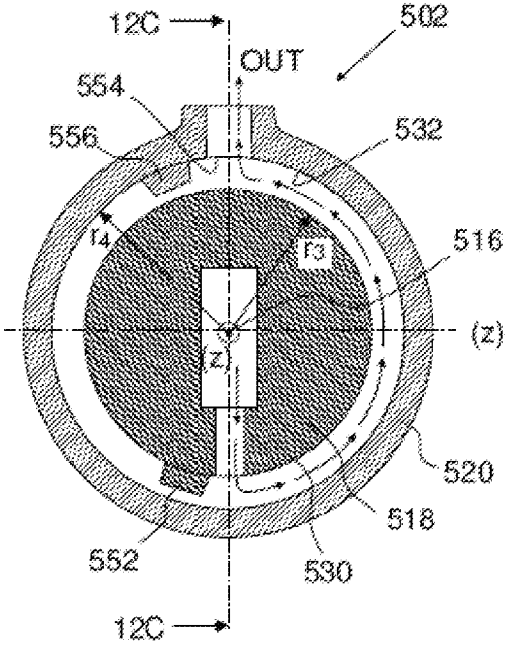

[Fig. 12 C]
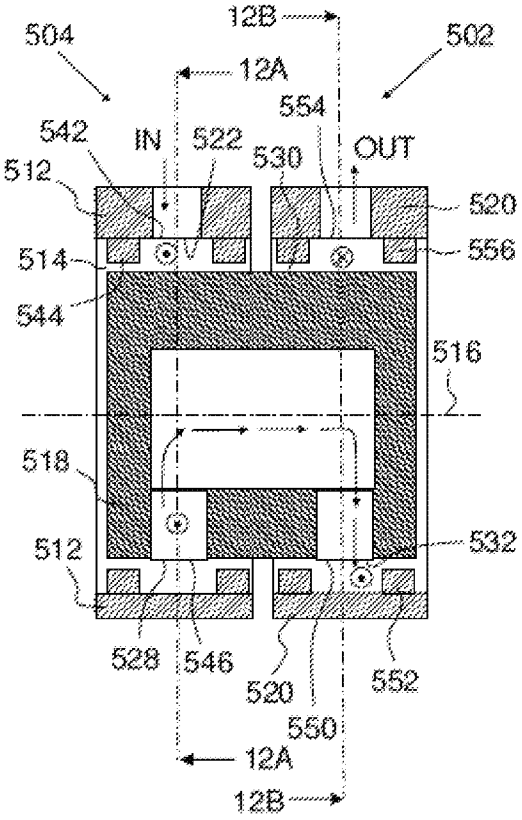

RADIOFREQUENCY RF ROTATING JOINT FOR ROTARY RF WAVE-GUIDING DEVICE AND ROTARY RF DEVICE INCLUDING SUCH A JOINT

CROSS-REFERENCE TO RELATED APPLICATIONS

This application claims priority to foreign French patent application No. FR 1873020, filed on Dec. 18, 2018, the disclosure of which is incorporated by reference in its entirety.

FIELD OF THE INVENTION

The present invention relates to a radiofrequency RF rotating joint having one or more radiofrequency RF transmission channels for connecting a first, fixed part of a rotary radiofrequency electromagnetic waveguiding device to a second part that is rotary relative to the first part of said rotary radiofrequency device and transmitting electromagnetic waves between the first part and the second part of the rotary radiofrequency device including during the rotation thereof.

The present invention relates also to a rotary radiofrequency device, for example a rotary RF antenna including such an RF rotating joint.

BACKGROUND

Generally, the RF rotating joints, narrowband or wideband, having one or more RF transmission channels, are useful not only to the moving satellites using low earth orbits which require directable or steerable antennas, but also to the geostationary satellites for some of their antennas, such as the earth-facing antennas for example.

Such RF rotating joints can also be useful to ground antennas such as, for example, gateway antennas to one or more satellites of a space system, said antennas forming part of access gateway stations, called "Gateways".

Among the known RF rotating joint structures, a first document FR 3 029 018 describes an RF rotating joint, supplied by two exciting, polarizing and diplexing RF chains. This RF transmission rotating joint is composed of two distinct parts, respectively fixed and rotary, fitted to one another without contact, parallel to the longitudinal axis of said joint, the two fixed and rotary parts comprising a cylindrical, axial through-opening forming an axial cylindrical waveguide common to the two fixed and rotary parts. The two parts, respectively fixed and rotary, of the rotating joint, respectively form a stator and a rotor that is rotationally mobile about the longitudinal axis. The cylindrical axial through-opening of the rotating joint thus forming a waveguide with circular section allows, with the particular configuration of the two driver units considered, the propagation of two electromagnetic waves with crossed circular polarization between the two RF driver units.

However, the RF rotating joint described in this first document presents a number of drawbacks, including:

- a limitation of the useful frequency bandwidth, less than 1 GHZ; and
- a limited number of RF transmission channels, here two RF transmission Tx channels and two RF reception Rx channels, that are difficult to extend; and production complexity.

In order to remedy the abovementioned drawbacks, a wideband RF transmission rotating joint for a rotary RF antenna is described in the patent application entitled "Joint tournant pour une antenne rotative et antenne rotative comportant un tel joint" (Rotating joint for a rotary antenna and rotary antenna comprising such a joint), filed on 19$^{th}$ September under the filing number FR1700950, and forming a second document. The rotary RF antenna comprises a first antenna part and a second antenna part, rotary relative to the first part, and the RF rotating joint is configured to connect the first and second parts of the rotary RF antenna, and to transmit RF electromagnetic signals between said first and second parts. The rotating joint takes the overall form of a ring segment with a variable aperture and a ring centre, comprises an axis of rotation (X) passing through the ring centre, and a plurality of circumferential directions extending in concentric circles disposed about the axis of rotation (X).

The wideband RF rotating joint described by the second document comprises:

- a stator intended to be fixed onto the first part of the antenna, and defining a first RF electromagnetic signal transmission surface, at right angles to the axis of rotation (X) and in the form of a portion of circular band of a disc; and
- a rotor intended to be fixed onto the second part of the antenna, and defining a second RF electromagnetic signal transmission surface, at right angles to the axis of rotation (X) and in the form of a portion of circular band of a disc.

One of the transmission surfaces comprises main RF electromagnetic signal delimiting means and the other comprises complementary RF electromagnetic signal delimiting means.

The rotor is mounted to rotate relative to the stator about the axis of rotation (X) such that, in any position of the rotor, at least a part of the transmission surface of the rotor is disposed facing at least a part of the transmission surface of the stator, and this is so without contact between the two parts, except for the external guiding devices, for example ball bearings.

In any position of the rotor, the facing parts of the transmission surfaces of the rotor and of the stator form between them at least one electromagnetic signal transmission channel, the transmission channel being delimited by the main and complementary delimiting means and extending in a circumferential direction.

This RF rotating joint solution is based on the use of meta-materials, by containing the wave in the guide using periodic blocks, and behaves as a waveguide bent according to the plane of the magnetic excitation component H of the wave. This solution, produced in two parts without contact, is wideband and exhibits good RF performance levels.

The embodiment of the RF rotating joint, the description of which is detailed in the second document, comprises four RF transmission channels, and proposes a configuration which can be generalized to any number N of transmission channels with a non-inconsiderable impact on compactness.

Indeed, since the compactness offered by this solution is a function of the angle of travel between the rotor and the stator, an RF rotating joint, configured according to this embodiment for an antenna of a low earth orbit LEO satellite mission requiring, for example, of the order of ±55° of angular range, is not compact. The radius of curvature of this type of RF joint cannot be made too small because the RF performance levels are directly impacted and degraded, and a minimum internal diameter of the joint of approximately five wavelengths must be observed. The volume of such an RF rotating joint increases very quickly when the number of channels increases.

Thus, the RF rotating joint configurations currently known do not make it possible to pass all of the Ka band in transmission Tx and reception Rx for two different polarizations of the RF electromagnetic waves with sufficient radio-electric matching performance levels and a small spatial bulk, as well as a great angular travel, typically ±55 degrees. Furthermore, the configurations of joints which use meta-materials in the form of periodic networks of blocks, require a very large number of blocks, for example 1500 blocks for a set of two transmission channels Tx and of two reception channels Rx which leads to a lengthy and costly machining. Moreover, this known RF rotating joint has a mechanical end-stop which limits the possibilities of stacking of the associated driven antenna.

A first technical problem is how to reduce the bulk of a wideband RF transmission rotating joint, in particular in the radial direction of extension of the joint and/or globally in all the directions of extension of the joint.

A second technical problem is how to increase the number of RF transmission channels, i.e. also the number of RF access ports, of a wideband RF transmission rotating joint with limited bulk.

SUMMARY OF THE INVENTION

To this end, the subject of the invention is a radiofrequency RF rotating joint for radio-electrically connecting together first and second parts of a rotary RF wave-guiding device, and for transmitting RF electromagnetic signals between said first and second parts of said rotary RF wave-guiding device, the RF rotating joint comprising:

- a first, external part, of overall annular form, having a first, internal, electrically conductive electromagnetic signal transmission surface, with symmetry of revolution over an angular interval of extension of a length that is non-zero and less than or equal to 360 degrees about a longitudinal axis of rotation (Z); and
- a second part, internal to the first part, having a second external, electrically conductive electromagnetic signal transmission surface, with symmetry of revolution over the angular interval of extension about the longitudinal axis (Z), disposed without mechanical contact facing the first, internal surface and rotationally mobile about the longitudinal axis (Z) over a predetermined interval of angular rotation; and
- an integer number N, greater than or equal to 1, of distinct RF transmission channels Vi, i varying from 1 to N, between the first part and the second part of the rotary RF wave-guiding device;

the first, internal electromagnetic signal transmission surface comprising a succession of a predetermined number NC, greater than or equal to 1 and less than or equal to N, of first sections of surfaces of revolution about the axis (Z), situated at different first levels L1(*k*), k varying from 1 to NC, along the longitudinal axis of symmetry (Z) about associated first, internal average radii r1(*k*), k varying from 1 to NC, and comprising N first RF axis ports and first, meta-material-based, RF electromagnetic signal containment and guidance means; and the second, external RF electromagnetic signal transmission surface comprising a succession of NC second sections of surfaces of revolution about the axis (Z), situated respectively at different first levels L1(*k*), k varying from 1 to NC, along the longitudinal axis of symmetry (Z) about associated second, external average radii r2(*k*), k varying from 1 to NC, strictly lower than the corresponding first, internal average radii r1(*k*), and comprising N second RF access ports and second, meta-material-based, RF electromagnetic signal containment and guidance means; and the first and second RF transmission surfaces being configured by the first and second average radii r1(*k*), r2(*k*), the first longitudinal levels L1(*k*), k varying from 1 to NC, the geometry of the first and second RF access ports, and the geometry of the first and second RF containment and guidance means, such that: each RF transmission channel Vi, i varying from 1 to N, comprises a different first curved sliding RF waveguide, and the N curved sliding RF waveguides are distributed angularly over the NC first sections of surfaces of revolution about the axis (Z), each of the NC sections of surfaces of revolution about the axis (Z) being situated along the longitudinal axis of symmetry (Z) at its associated first level L1(*k*), k varying from 1 to NC.

According to particular embodiments, the RF rotating joint comprises one or more of the following features:

- each first curved sliding RF waveguide, associated with an RF transmission channel Vi, i varying from 1 to N, is delimited: in radial height or small side $\underline{b}_k$ between a first section of surface of revolution and a second section of surface of revolution about the axis (Z) of rank k of the first and second transmission surfaces, k lying between 1 and NC, in axial height or large side $\underline{a}_k$ between the two first lateral containment and guidance walls of the first and second sections of surfaces of revolution about the axis (Z) of rank k, and in length between two first circumferential containment and guidance end walls, disposed, for one, in proximity to the first associated RF access port and, for the other, in proximity to the second associated RF access port, without one of these two first circumferential end walls being interposed between said two first RF access ports;
- the integer number N of RF transmission channels is equal to 1, and the single RF transmission channel V1 comprises a single first curved sliding waveguide, disposed orthogonally to the longitudinal axis (Z) of symmetry at a predetermined level L1;
- the integer number N of distinct RF transmission channels Vi is greater than or equal to 2, and each RF transmission channel Vi, i varying from 1 to N, comprises a first associated distinct curved sliding RF waveguide, and the N first curved sliding RF waveguides are distributed angularly along one and the same transverse circle, disposed orthogonally to the longitudinal axis of symmetry at a first predetermined level L1;
- the integer number N, of distinct RF transmission channels Vi is greater than or equal to 2, and each RF transmission channel Vi, i varying from 1 to N, comprises a first associated distinct curved sliding RF waveguide, and the N first curved sliding RF waveguides are distributed longitudinally along the axis of symmetry (Z) at first predetermined distinct levels Li along the axis (Z), i varying from 1 to N;
- the integer number N of distinct RF transmission channels Vi is greater than or equal to 3, and each RF transmission channel Vi, i varying from 1 to N, comprises a first associated distinct curved sliding RF waveguide, and the N first curved sliding RF waveguides are distributed longitudinally along the axis of symmetry (Z) at a number NC of first levels greater than or equal to 2 and strictly less than N; and at least two first curved sliding RF waveguides out of the N first rotating guides are disposed orthogonally to the axis of symmetry (Z) at one and the same predetermined level and each delimited by a corresponding angular sector;

the radiofrequency RF rotating joint defined above further comprises a third, outer part, of overall annular form, mounted side-by-side with the first, annular outer part along the longitudinal axis of symmetry (Z) by being blocked in translation along said axis (Z), and free to rotate with the first, outer part to rotate about the second, inner part; and the second, inner part further comprises a third, outer, electrically conductive RF electromagnetic signal transmission surface, with symmetry of revolution about the longitudinal axis (Z) over the angular interval of extension; and the third, outer part comprises a fourth, internal, electrically conductive RF electromagnetic signal transmission surface, with symmetry of revolution about the longitudinal axis (Z) over the angular interval of extension, disposed without mechanical contact facing the third, external surface and mobile about the longitudinal axis (Z) over the predetermined interval of angular rotation; and the third, outer RF transmission surface comprises a succession of NC third sections of surfaces of revolution about the axis (Z), situated at different second levels L2(*k*), k varying from 1 to NC, along the longitudinal axis of symmetry (Z) about associated third, external average radii r3(*k*), k varying from 1 to NC, and comprises N third RF access ports and third, meta-material-based, RF electromagnetic signal containment and guidance means; and the fourth, internal RF transmission surface comprises a succession of NC fourth sections of surfaces of revolution about the longitudinal axis (Z), situated respectively at the different second levels L2(*k*), k varying from 1 to NC, along the longitudinal axis (Z) about associated fourth internal average radii r4(*k*), k varying from 1 to NC, strictly less than the corresponding third external average radii r3(*k*), and comprises N fourth RF access ports and fourth, meta-material-based, RF electromagnetic signal containment and guidance means; and the first, second, third and fourth RF transmission surfaces are configured by the first, second, third and fourth average radii r1(*k*), r2(*k*), r3(*k*), r4(*k*), the first and second longitudinal levels L1(*k*), L2(*k*), the geometry of the first, second, third and fourth RF access ports and the geometry of the first, second, third and fourth RF containment and guidance means, such that: each RF transmission channel Vi, i varying from 1 to N, comprises, connected in series, a first curved sliding RF waveguide between the first, outer part and the second, inner part, and a second curved sliding RF waveguide between the second, inner part and the third, outer part; and the N first and second curved sliding RF waveguides of each transmission channel Vi, i varying from 1 to N, being different, disposed orthogonally to the axis of symmetry (Z), distributed angularly and respectively over the NC second and third sections of surface of revolution of the second, external surface and of the third, external surface, the second and third sections of surfaces of revolution about the longitudinal axis (Z) of the first and second waveguides of each channel Vi being paired with one another, having one and the same index k(i) of second and third sections on the second and third surfaces and being situated along the longitudinal axis (Z) at their associated levels L1*k*(*i*), L2*k*(*i*);

the first, outer part comprises N first external channel connection RF terminals, connected respectively one-to-one to the N first RF access ports of the N corresponding first curved sliding RF waveguides of the first RF transmission surface through N distinct corresponding first transition links, passing through the first, outer part;

the second, inner part comprises N second, external RF transmission channel connection RF terminals, connected respectively one-to-one to the N second RF access ports of the corresponding first curved sliding RF waveguides of the second RF transmission surface through N distinct corresponding second transition links which pass longitudinally and internally through the second, inner part; the first, outer part and the second, inner part are respectively a stator and a rotor or are respectively reciprocally a rotor and a stator;

the third, outer part comprises N second, external RF transmission channel connection RF terminals, connected respectively one-to-one to the N fourth RF access ports of the corresponding N second curved sliding RF waveguides of the fourth RF transmission surface through N second distinct corresponding transition links, passing through the third, outer part, and the N second access ports of the first curved sliding waveguides are connected one-to-one per unitary transmission channel to the N third access ports of the second curved sliding waveguides;

the first, outer part and the third, outer part are respectively a stator and a rotor or are respectively reciprocally a rotor and a stator;

the two lateral containment and guidance walls of each first curved sliding waveguide are each formed by a one- or two-dimensional network of blocks with electrically conductive surface; and the blocks of the two lateral walls of each first curved sliding waveguide are slender and protrude from one and the same electrically-conductive circumferential surface of the first waveguide, or from the two electrically-conductive circumferential surfaces of the first waveguide with one lateral wall per circumferential surface, or by interleaving of the blocks from the two electrically-conductive circumferential surfaces for at least one lateral wall taken from among the two lateral walls;

the two circumferential containment and guidance end walls of each first curved sliding waveguide are disposed on either side of the first and second RF access ports; and the two circumferential containment and guidance end walls are each formed from a one- or two-dimensional network of blocks with electrically-conductive surface, and the blocks of two circumferential end walls are slender and protrude respectively from the first transmission surface for the first end wall associated with and disposed in the vicinity of the first RF access port and from the second transmission surface for the second end wall associated with and disposed in the vicinity of the second RF access port;

the blocks of the end walls of the one or more RF transmission channels situated at one and the same longitudinal level are formed by circumferential lines of blocks arranged combwise so as to allow a free mechanical crossing of the first and of the second end walls when the first and second parts rotate relative to one another while ensuring their electromagnetic wave containment function;

RF electromagnetic signal containment and guidance means taken from among the first and second RF electromagnetic signal containment and guidance means are divided between first curved sliding waveguides circumferentially or laterally adjacent;

the first internal average radii r1(*k*) and the second external average radii r2(*k*), k varying from 1 to NC, are respectively equal to a first constant r1 and to a second constant r2;

the number NC of sections of the first transmission surface, respectively of sections of the second transmission surface, is greater than or equal to 2, and at least two sections of the first transmission surface have different first internal radii; and the at least two sections of the second transmission surface, associated facing one another, have different second external radii;

the NC first sections of surfaces of revolution about the axis (Z) are cylindrical sections about the axis (Z), situated at different first levels L1(*k*), k varying from 1 to NC, along the longitudinal axis of symmetry (Z) and associated with first internal radii r1(*k*), k varying from 1 to NC; and the NC second sections of surfaces of revolution about the axis (Z) are cylindrical sections about the axis (Z), situated respectively at the different first levels L1(*k*), k varying from 1 to NC, along the longitudinal axis of symmetry (Z) and associated with second external radii r2(*k*), k varying from 1 to NC; and/or the NC third sections of surfaces of revolution about the axis (Z) are cylindrical sections about the axis (Z), situated at different second levels L2(*k*), k varying from 1 to NC, along the longitudinal axis of symmetry (Z) and associated with third external radii r3(*k*), k varying from 1 to NC; and the NC fourth sections of surfaces of revolution about the axis (Z) are cylindrical sections about the axis (Z), situated respectively at the different second levels L2(*k*), k varying from 1 to NC, along the longitudinal axis of symmetry (Z) and associated with fourth internal radii r4(*k*), k varying from 1 to NC.

Also a subject of the invention is a rotary RF waveguiding device comprising: a first part, a second part that is rotary relative to the first part, and an RF rotating joint as described above, intended to connect the first and second parts of said rotary device and to transmit electromagnetic signals between these two parts.

BRIEF DESCRIPTION OF THE DRAWINGS

The invention will be better understood on reading the following description of several embodiments, given purely by way of example and with reference to the drawings in which:

FIG. 1A and FIG. 1B are respectively a first longitudinal cross section along a cutting plane 1A-1A and a second transverse cross section along a cutting plane 1B-1B of a first embodiment of an RF rotating joint according to the invention in which the RF rotating joint comprises a single RF transmission channel;

FIG. 2A, FIG. 2B and FIG. 2C are respectively a first planar developed view of the single curved RF transmission channel formed by the assembly of the first and second RF transmission faces or surfaces of a first curved sliding waveguide, here single, forming the RF rotating joint of FIGS. 1A and 1B, a second planar developed view of the first curved RF transmission surface of said first curved sliding waveguide, and a third planar developed view of the second curved RF transmission surface of said first curved sliding waveguide;

FIG. 3 is a partial view of a first, generic curved sliding waveguide, forming, for example, the RF transmission channel of the rotating joint according to the invention of FIGS. 1A-1B and 2A-2C which details the structure of the metamaterials used by the two lateral RF electromagnetic wave containment walls inside the first RF rotating waveguide, the two lateral containment walls both having one and the same radius of curvature in their respective radial transverse planes equal to the first internal radius of the first annular part;

FIG. 4A, FIG. 4B and FIG. 4C are, respectively, first, second and third views of possible configurations of arrangements of the two lateral containment walls of a first curved sliding waveguide of an RF transmission channel on the first and second RF transmission surfaces;

FIG. 5 is a view of a transverse cross section of a particular combwise embodiment of a first circumferential containment end wall and of a second circumferential containment end wall in a relative crossing position which allows a mechanical rotation over a complete revolution between the first, annular part and the second, cylindrical or tubular part;

FIG. 6A and FIG. 6B are respectively a first view of plane H non-zero curvature (magnetic field component) of a curved sliding RF waveguide, possibly wideband, according to the second document of the state of the art and a second view of plane E non-zero curvature (electrical field component) of the first curved sliding RF waveguide, possibly wideband, according to the invention of FIGS. 1A and 1B, FIG. 7A and FIG. 7B are respectively a longitudinal cross section along a longitudinal cutting plane 7A-7A and a transverse cross section along a transverse cutting plane 7B-7B of a second embodiment of an RF rotating joint according to the invention, generalizing the RF rotating joint of the first embodiment of FIGS. 1A and 1B, and in which the RF rotating joint comprises two RF transmission channels, produced using two first curved sliding RF waveguides, possibly wideband, distributed angularly over one and the same transverse circle of the second RF transmission surface, contained in a transverse plane situated at a predetermined level along the longitudinal axis of symmetry and the axis of rotation (Z);

FIG. 8A, FIG. 8B and FIG. 8C are respectively a first transverse cross section along a first transverse cutting plane 8A-8A situated at a first longitudinal level L1 on the longitudinal axis of symmetry and axis of rotation (Z), a second transverse cross section along a second transverse cutting plane 8B-8B situated at a second longitudinal level L2 on the longitudinal axis of symmetry and axis of rotation (Z), and a third longitudinal cross section along a third longitudinal cutting plane 8C-8C of a third embodiment of an RF rotating joint according to the invention, generalizing the RF rotating joint of the first embodiment of FIGS. 1A and 1B and of the second embodiment of the rotating joint of FIGS. 7A-7B, in which the RF rotating joint comprises two RF transmission channels, produced using two curved sliding RF waveguides, possibly wideband, distributed longitudinally on the longitudinal axis of symmetry and axis of rotation (Z) at two different levels along L1, L2 of two different transverse circles of the second RF transmission surface substantially of the same second external radius r2;

FIG. 9 is an external view of an RF rotating joint according to a fourth embodiment of the invention, a hybrid of the second and third embodiments of FIGS. 7A-7B and 8A-8C, in which the RF rotating joint comprises four RF transmission channels, two transmission Tx and two reception Rx, with four external connection input RF ports, situated towards the outside of the first, annular part, here forming a stator, and with four external connection output RF ports, situated towards the inside on the tubular internal face of the second, cylindrical part, here forming a rotor, the four RF transmission channels being produced here using four first wideband curved sliding RF waveguides, two first sliding waveguides dedicated to the two reception Rx RF transmission channels being distributed angularly over one and the same first transverse circle of the second transmission surface, situated at a first longitudinal level L1, and two first sliding waveguides dedicated to the two transmission Tx RF transmission channels being distributed angularly over one and the same second transverse circle of the second transmission surface, situated at a second longitudinal level L2;

FIG. 10 is a comparative view of the respective sizes and bulks of a wideband RF rotating joint according to the known structure described in the second document cited and of a wideband RF rotating joint according to the fourth embodiment of the invention whose requirements in terms of RF transmission performance levels (number of RF transmission channels, frequency and bandwidth) and of angular travel are identical to those of FIG. 10;

FIG. 11A, FIG. 11B and FIG. 11C are respectively views of three relative angular positions of the second, cylindrical male part, here forming a rotor, and of the first, annular female part, here forming a stator, corresponding to an extreme travel in one direction, a neutral position and an extreme travel in the other direction;

FIG. 12A, FIG. 12B and FIG. 12C are respectively a first transverse cross section along a first transverse cutting plane 12A-12A situated at a first longitudinal level L1 on the longitudinal axis of symmetry and axis of rotation (Z), a second transverse cross section along a second transverse cutting plane 12B-12B situated at a second longitudinal level L2 on the longitudinal axis of symmetry and axis of rotation (Z), and a third longitudinal cross section along a third longitudinal cutting plane 12C-12C of a fifth embodiment of an RF rotating joint according to the invention, in which the RF rotating joint here comprises a single RF transmission channel, produced using a first curved sliding RF waveguide, possibly wideband, between the first, annular part and the second, cylindrical part and a second wideband curved sliding RF waveguide between the second, cylindrical part and a third, annular part, the first and second curved sliding RF waveguides, possibly wideband, being mounted in series and alongside one another along the longitudinal axis of symmetry and axis of rotation, and the second part being mounted to rotate freely with respect to the first, outer part and the third, outer part.

DETAILED DESCRIPTION

A first underlying concept of the invention is to use meta-materials to replace the metal electromagnetic wave containment walls of one or more RF rotating waveguides and to make the RF rotating waveguide or guides without contact according to the principle of waveguide with aperture in groove or spline form (called "groove gap waveguide"), described for example in the document by Eva Rajo-Iglesias et al., entitled "Groove Gap Waveguide: A Rectangular Waveguide Between Contactless Metal Plates Enabled by Parallel-Plate Cut-Off", and published in Proceedings of the Fourth European Conference on Antenna and Propagation, 8 Jul. 2010.

A second underlying concept of the invention is to choose a guiding structure for the curved sliding RF waveguide according to the plane E electrical component of the electromagnetic field instead of the plane H magnetic excitation component of the same electromagnetic field, which makes it possible to have a smaller radius of radial curvature and obtain a much more compact RF rotating joint.

According to FIGS. 1A and 1B and a first embodiment, a radiofrequency RF rotating joint 2 according to the invention here comprises a single RF transmission channel 4.

The radiofrequency RF rotating joint 2 is configured to mechanically connect to one another first and second parts 6, 8 of a rotary RF wave-guiding device 10, for example of a rotary RF antenna, illustrated schematically and solely in FIG. 1A to simplify the reading, and to transmit RF electromagnetic signals between said first and second parts 6, 8 of the rotary antenna 10.

The radiofrequency RF rotating joint 2 comprises:

- a first, outer part 12, of overall annular form, surrounding a hole 14, for example of cylindrical form, which is passed through by a longitudinal axis of cylindrical symmetry and of rotation (Z) 16, and
- a second, inner part 18, for example of outer cylindrical form, mounted in the hole 14 to revolve about the axis of rotation and of symmetry of revolution 16 (Z).

The first, outer part 12 comprises a first, metallic, internal RF electromagnetic signal transmission surface 22, here having a cylindrical form, defined by a first internal radius r1 equal to the radius of the cylindrical hole 14.

The second, inner part 18 comprises a second, external, metallic RF electromagnetic signal transmission surface 28, here having a cylindrical form, defined by a second, external radius r2, strictly less than the first, internal radius r1, and rotationally mobile relative to the first, internal transmission surface 22 about the axis (Z) 16, according to an angle of angular displacement $\alpha$, lying within a predetermined angular aperture range 30.

The first, internal transmission surface 22 here comprises a single first RF access port 32 and first RF electromagnetic signal containment and guidance means 34, using meta-materials such as, for example, periodic structures of blocks with electrically-conductive surface.

The second, external transmission surface 28 here comprises a single second RF access port 38 and second RF electromagnetic signal containment and guidance means 40, using meta-materials such as, for example, periodic structures of blocks with electrically-conductive surface.

The first and second transmission surfaces 22, 28 are configured by the first and second radii r1, r2, the geometry of the first and second RF access ports 32, 38, and the geometry of the first and second RF containment and guidance means 34, 40, such that:

- the single transmission channel 4 comprises a first curved sliding RF waveguide 42, here singular, and
- the first curved sliding RF waveguide is without contact and curved about the longitudinal axis of cylindrical symmetry (Z) along a transverse circle 44 of the second transmission surface 28, contained in a transverse plane 45, situated along the longitudinal axis of symmetry (Z) at a first predetermined level L1.

According to FIGS. 1A-1B and FIGS. 2A-2C, the first curved sliding RF waveguide 42 is delimited in radial height or small side b between a first circumferential metal track 46 and a second circumferential metal track 48 of the first and second metal surfaces 22, 28, in axial height or large side a in the longitudinal direction of the axis of symmetry (Z) between two lateral containment and guidance walls 52, 54, spaced apart by said width a, and in length in the circumferential direction between a first circumferential end wall 62 and a second circumferential end wall 64, disposed respectively in proximity to the first RF access port 32 and to the second RF access port 38, moving away from a median half-plane of reference about which the angular movement takes place.

According to FIG. 3 and a detailed part of the first curved sliding waveguide 42 of FIGS. 1A-1B and 2B, given by way of example, the lateral containment and guidance walls 52 and 54, spaced apart by the width a, are each formed from a one- or two-dimensional network of metal blocks 68, spaced apart periodically according to a spacing pitch p and having a height $h_p$. The spacing pitch of the blocks is less than or equal to a fraction of the wavelength and the height hp of the blocks satisfies the relationship:

$$r_1 - r_2 - \frac{\lambda}{4} \leq h_p < r_1 - r_2 \quad \text{[Math. 1]}$$

The rows or lines of blocks 68 thus dimensioned form lateral electromagnetic field containment and guidance walls which replace conventional metal walls of small side b of the first sliding waveguide and prevent the field from escaping. The opening left by the blocks between the metal tracks of the first and second transmission surfaces, typically up to 0.5 mm in Ka band, allows the first and second transmission surfaces to slide between them without contact so as not to degrade the life of the antenna and not to generate particles.

Generally, the blocks with electrically-conductive surface of the two lateral containment and guidance walls of one and the same first curved sliding waveguide are slender and can protrude, either from one and the same circumferential transmission surface taken from among the first and second circumferential transmission surfaces of said first curved sliding waveguide as described in FIGS. 4A and 4C, or from the two circumferential transmission surfaces of said first curved sliding waveguide with a different circumferential transmission surface per lateral wall as described in FIG. 4B, or by interleaving of the blocks from the two circumferential transmission surfaces for at least one lateral wall taken from among the two lateral walls.

Like the lateral containment and guidance walls 52, 54 of FIGS. 1A-1B and 3, the two circumferential containment end walls 62, 64 of the first curved sliding RF waveguide 52, disposed on either side of the first and second access ports 32, 38 are each formed by a one- or two-dimensional network of metal blocks spaced apart periodically with the same dimensioning in terms of spacing pitch p and of height hp.

The rows of blocks thus dimensioned form lengthwise electromagnetic field containment end walls between the first and second RF access ports which replace conventional metal walls of small side b of the first curved sliding waveguide and prevent the field from escaping on the circumferential ends while allowing a sliding without contact between the first transmission surface and the second transmission surface.

Generally, the blocks of the two end walls are slender and protrude from the first transmission surface for the first end wall associated with and disposed in the vicinity of the first RF access port, and from the second transmission surface for the second end wall associated with and disposed in the vicinity of the second RF access port.

According to FIG. 5, and in particular, the blocks of the end walls of the first curved sliding RF waveguide 42 of the RF transmission channel 4 are formed by circumferential rows or lines 72, 73, 74, 75, 76, 78 of blocks arranged combwise so as to allow a free mechanical crossing of the first and second end walls 62, 64 when the first and second parts 12, 18 revolve between them while ensuring their electromagnetic wave containment function.

The first curved sliding RF waveguide 42 of the RF rotating joint according to the invention, described in FIGS. 1A and 1B, differs from a curved sliding RF waveguide of the known RF rotating joint described in the second document cited in that the deformation of the RF containment and guidance structure is applied according to the plane E of the electrical component of the electromagnetic waves instead of the plane H of the magnetic component of said same waves. That thus makes it possible to obtain a much smaller radius of curvature of the first and second transmission surfaces and consequently an RF rotating joint structure that is much more compact in terms of volume. By contrast, such a structure requires having containment blocks on a curved surface instead of a planar surface as for the RF rotating joint known from the second document.

According to FIG. 6A, the structure of the curved sliding RF waveguide 82, used to produce the known RF rotating joint 84 of the second document cited, has a non-zero curvature of the plane H of the magnetic excitation component of the electromagnetic wave whereas the planes of extension of the first and second tracks 86, 88 of the large side a of the curved sliding RF waveguide 82 are planar and at right angles to the axis of rotation (Z) of the RF rotating joint 82. The walls of small side b of the curved sliding waveguide, formed by lateral containment walls 90, 92 are, here, straight sections of cylindrical surfaces concentric about the axis of rotation (Z) of the RF rotating joint 82.

Differently and according to FIG. 6B, the structure of the first curved sliding RF waveguide 42, used to produce the RF rotating joint 2 according to the invention of FIGS. 1A and 1B has a non-zero curvature of the plane E of the electrical field component of the electromagnetic field, whereas the planes of extension of the walls of small side b of the same first curved sliding RF waveguide 42, formed by the lateral containment walls 52, 54, are planar and at right angles to the axis of rotation (Z) of the RF rotating joint according to the invention. The walls of large side a, formed by the first and second circumferential tracks 22, 28, are, here, straight sections of cylindrical surfaces concentric about the axis of rotation (Z) of the RF rotating joint.

With equivalent radius of curvature, the surfaces 22 and 28 of the first curved sliding waveguide 42 of FIG. 6B are substantially closer together than the surfaces 90 and 92 of the curved sliding waveguide 82 of FIG. 6A corresponding to the design and the structure of the second document cited, with, for example, a "large side to small side" ratio equal to 4/1. Consequently, the RF transmission parameters, such as the Standing Wave Ratio (SWR), which depend thereon, will be less degraded in the configuration of the first curved sliding waveguide of FIG. 6B than in the configuration of the state of the art as described in the second document cited and FIG. 6A, with equivalent radius of curvature. That means that the plane E curvature configuration according to the invention makes it possible to reduce the bulk of the RF rotating waveguide, overall and in particular in the plane transversal to the axis of rotation (Z), without in any way greatly degrading the SWR of the waveguide.

The RF rotating joint 2 according to the invention, based on the use of an electrical plane E curved sliding waveguide will therefore have the particular feature of a radial electrical field E, unlike a curved sliding RF rotating joint 82 of the state of the art using a magnetic excitation plane H curved waveguide, whose electrical field is axial according to the axis of rotation (Z).

Considering the plane E rotating joint according to the invention of FIG. 6B and the known plane H rotating joint of FIG. 6A, the addition of the transmission channels to the plane H joint of FIG. 6A increases its diameter (channels sharing the small side of the guide in the plane of rotation). By contrast, the addition of the channels to the plane E rotating joint does not increase its diameter but does increase its height (channels sharing the small side of the guide, at right angles to the plane of rotation). Consequently, the addition of channels in the plane H configuration of FIG. 6A increases the volume quadratically, whereas the addition of channels in the plane E of FIG. 6B increases the volume quasi-linearly.

According to FIGS. 7A and 7B and a second embodiment, generalizing the RF rotating joint 2 of the first embodiment of FIGS. 1A and 1B, a radiofrequency RF rotating joint 202 according to the invention comprises a first RF transmission channel 204 and a second RF transmission channel 206.

The RF rotating joint 202 is configured to mechanically connect to one another first and second parts of a rotary RF wave-guiding device and to transmit RF electromagnetic signals between said first and second parts of the rotary antenna.

The RF rotating joint 202 comprises:

- a first, outer part 212, of overall annular form, surrounding a cylindrical hole 214 which is passed through by a longitudinal axis of symmetry of revolution 216 (Z), and
- a second, inner part 218, of cylindrical external form, mounted in the cylindrical hole 214 to revolve about the axis of rotation and of symmetry 216 (Z).

The first, outer part 212 comprises a first internal, electrically conductive, RF electromagnetic signal transmission surface 222, here having a cylindrical form, defined by a first internal radius r1, equal to the radius of the cylindrical hole 214.

The second, inner part 218 comprises a second, external, electrically conductive, RF electromagnetic signal transmission surface 228, here having a cylindrical form, defined by a second, external radius r2, strictly less than the first, internal radius r1, and rotationally mobile relative to the first, internal transmission surface 222 about the axis (Z) 16, according to an angle of angular displacement α, lying within a predetermined angular aperture range 230.

The first, internal transmission surface 222 here comprises a first RF access port 232, a second first RF access port 233, and first RF electromagnetic signal containment and guidance means 234, using meta-materials such as, for example, periodic structures of blocks with electrically-conductive surface.

The second, external transmission surface 228 here comprises a first second RF access port 238, a second second RF access port 239, and second, meta-material-based, RF electromagnetic signal containment and guidance means 240.

The first and second transmission surfaces 222, 228 are configured by the first and second radii r1, r2, the geometry of the first first, second first, first second, second second RF access ports 232, 233, 238, 239, and the geometry of the first and second RF containment and guidance means 234, 240, such that:

- the first RF transmission channel 204 and the second RF transmission channel 206 respectively comprise a first curved sliding RF waveguide 242 and a second curved sliding RF waveguide 243; and
- the first curved sliding RF waveguide 242 and the second curved sliding RF waveguide 243 are distributed angularly along one and the same circle 244 of the second transmission surface 228, said same circle 244 being contained in a transverse plane 445 situated at a first predetermined level along the axis (Z).

According to FIGS. 7A and 7B, the first curved sliding RF rotating waveguide 242 is delimited in radial height or small side b between two first first metal tracks 246, 248 of the first and second transmission surfaces 222, 228, in axial height or large side a in the longitudinal direction of the axis of symmetry (Z) between two first first lateral containment and guidance walls spaced apart by said width a, and in length in the circumferential direction between two first first circumferential end walls, disposed, for one, in proximity to the first first RF access port and, for the other, in proximity to the first second RF access port, without one of them being interposed between the two first RF access ports.

According to FIGS. 7A and 7B, the second first curved sliding RF waveguide 243 is delimited in radial height or small side b between two second first metal tracks 250, 252 of the first and second transmission surfaces 222, 228, in axial height or large side a in the direction of the axis of symmetry (Z) between two second first lateral containment and guidance walls spaced apart by said radial height a, and in length in the circumferential direction between two second first circumferential end walls, disposed, for one, in proximity to the second first first RF access port and, for the other, in proximity to the second second RF access port, without one of them being interposed between the two second first and second RF access ports.

Generally, an RF rotating joint according to the second embodiment, configured to connect to one another first and second parts of a rotary RF wave-guiding device, and to transmit RF electromagnetic signals between said first and second parts of said rotary RF device, comprises:

- a first, outer part, of overall annular form and surrounding a cylindrical hole passed through in a longitudinal direction by a cylindrical axis of symmetry (Z); and
- a second, inner part, of cylindrical form, mounted in the cylindrical hole to revolve about the axis of rotation of cylindrical symmetry (Z); and
- an integer number N, greater than or equal to 2, of distinct and separate transmission channels between the first antenna part and the second antenna part.

The first, outer part comprises a first, internal, electrically conductive RF electromagnetic signal transmission surface, having a cylindrical form, defined by a first, internal radius r1 equal to the radius of the hole.

The second, inner part comprises a second, external, electrically-conductive RF electromagnetic signal transmission surface, having a cylindrical form, defined by a second, external radius r2, strictly less than the first, internal radius r1, and rotationally mobile relative to the first, internal transmission surface about the axis (Z), according to an angle of angular displacement α, lying within a predetermined angular aperture range.

The first, internal transmission surface comprises N first RF access ports and first RF electromagnetic signal containment and guidance means, using meta-materials such as, for example, periodic structures of blocks with electrically-conductive surface.

The second, external transmission surface comprises N second RF access ports and second RF electromagnetic signal containment and guidance means, using meta-materials such as, for example, periodic structures of blocks with electrically-conductive surface.

The first and second transmission surfaces are configured by the first and second radii r1, r2, the geometry of the first and second RF access ports, and the geometry of the first and second RF containment and guidance means, such that:

each RF transmission channel comprises a first curved sliding RF waveguide, and the N first curved sliding guides are distributed angularly along one and the same transverse circle of the second, external transmission surface, said transverse circle being situated along the longitudinal axis of symmetry at a predetermined level.

Each curved sliding RF waveguide, associated specifically with an RF transmission channel numbered by an index i, i lying between 1 and N, is delimited in radial height or small side b between a first track and a second track of rank i of the first and second transmission surfaces, cut at their centre by one and the same transverse plane PL1, in axial height or large side a in the longitudinal direction of the axis of symmetry (Z) between two first lateral containment and guidance walls spaced apart by said width a, and in length in the circumferential direction of the transverse circle between two first circumferential end walls, disposed, for one, in proximity to the first associated RF access port and, for the other, in proximity to the second associated RF access port, without one of these two first end walls being interposed between said two first RF access ports.

According to FIGS. 8A, 8B and 8C and a third embodiment, generalizing the RF rotating joint 2 of the first embodiment of FIGS. 1A and 1B, a radiofrequency RF rotating joint 302 according to the invention comprises a first RF transmission channel 304 and a second RF transmission channel 306.

The RF rotating joint 302 is configured to mechanically connect to one another first and second parts of a rotary RF wave-guiding device and to transmit RF electromagnetic signals between said first and second parts of said rotary guiding device.

The RF rotating joint 302 comprises:

a first, outer part 312, of overall annular form, surrounding a cylindrical hole 314 which is passed through by a longitudinal axis of cylindrical symmetry 316 (Z), and a second, inner part 318, of cylindrical form, mounted in the cylindrical hole 314 to revolve about the axis of rotation and of cylindrical symmetry 316 (Z).

The first, outer part 312 comprises a first, internal, metal RF electromagnetic signal transmission surface RF, having a cylindrical form, defined by a first, internal radius r1, equal to the radius of the cylindrical hole 314.

The second, inner part 318 comprises a second, external, metal RF electromagnetic signal transmission surface 328, having a cylindrical form, defined by a second, external radius r2, strictly less than the first, internal radius r1, and rotationally mobile relative to the first, internal transmission surface 322 about the axis (Z), according to an angle of angular displacement α, lying within a predetermined angular aperture range 330.

The first, internal transmission surface 322 here comprises a first first RF access port 332, a second first RF access port 333, and first, meta-material-based, RF electromagnetic signal containment and guidance means 334.

The second, external transmission surface 328 here comprises a first second RF access port 338, a second second RF access port 339, and second, meta-material-based, RF electromagnetic signal containment and guidance means 340.

The first and second transmission surfaces 322, 328 are configured by the first and second radii r1, r2, the geometry of the first first, second first, first second, second second RF access ports 332, 333, 338, 339, and the geometry of the first and second RF containment and guidance means 334, 340, such that:

the first RF transmission channel 304 and the second RF transmission channel 306 respectively comprise a first first curved sliding RF waveguide 342 and a second first curved sliding RF waveguide 343, distributed respectively and longitudinally along the axis of symmetry (Z) 316 according to a first circle 344 of the second transmission surface 328, said first circle 344 being contained in a first transverse plane PL1 345 situated at a first predetermined level L1 along the axis (Z) and according to a second circle 346 of the second transmission surface 328, said second circle 346 being contained in a second transverse plane 347 situated at a predetermined second level L2 along the axis (Z).

According to FIGS. 8A and 8C, the first first curved sliding RF waveguide 242 is delimited in radial height or small side b between two first first metal tracks 352, 354 of the first and second transmission surfaces 322, 328 cut by the first transverse plane PL1, in axial height or large side a in the longitudinal direction of the axis of symmetry (Z) between two first first lateral containment and guidance walls 356, 358 spaced apart by said width a, and in length in the circumferential direction between two first first circumferential end walls 360, 361, disposed, for one, in proximity to the first first RF access port and, for the other, in proximity to the first second RF access port, without one of them being interposed between the two first RF access ports.

According to FIGS. 8B and 8C, the second first curved sliding RF rotating waveguide 343 is delimited in radial height or small side b between two second first metal tracks 362, 364 of the first and second transmission surfaces 322, 328 cut by the second transverse plane PL2, in axial height or large side a in the longitudinal direction of the axis of symmetry (Z) 316 between two second first lateral containment and guidance walls 358, 368 spaced apart by said width a, and in length in the circumferential direction between two second first circumferential end walls 370, 371 disposed, for one, in proximity to the second first RF access port and, for the other, in proximity to the second second RF access port, without one of them being interposed between the two second first and second RF access ports.

Generally, an RF rotating joint according to the third embodiment, configured to connect to one another first and second parts of a rotary RF wave-guiding device, and to transmit RF electromagnetic signals between said first and second parts of said rotary RF device, comprises:

a first, outer part, of overall annular form, surrounding a cylindrical hole which is passed through by a longitudinal axis of cylindrical symmetry (Z); and a second, inner part, of cylindrical form, mounted in the cylindrical hole to revolve about the axis of rotation and of cylindrical symmetry (Z); and an integer number N, greater than or equal to 2, of distinct and separate transmission channels Vi between the first part of the rotary guiding device and the second part of said device, i designating an index identifying the channel Vi lying between 1 and N.

The first, outer part comprises a first, electrically-conductive, internal RF electromagnetic signal transmission surface, having a cylindrical form, defined by a first, internal radius r1 equal to the radius of the cylindrical hole.

The second, inner part comprises a second, external, electrically conductive RF electromagnetic signal transmission surface, having a cylindrical form, defined by a second, external radius r2, strictly less than the first, internal radius r1, and rotationally mobile relative to the first, internal transmission surface about the axis of symmetry (Z), according to an angle of angular displacement α, lying within a predetermined angular aperture range.

The first, internal transmission surface comprises N first RF access ports and first, meta-material-based, RF electromagnetic signal containment and guidance means.

The second, external transmission surface comprises N second RF access ports and second, meta-material-based, RF electromagnetic signal containment and guidance means.

The first and second transmission surfaces are configured by the first and second radii r1, r2, the geometry of the first and second RF access ports, and the geometry of the first and second RF containment and guidance means, such that:

each RF transmission channel Vi comprises a first associated distinct curved sliding RF waveguide, and N first curved sliding RF waveguides are distributed longitudinally along the axis of symmetry (Z) according to N first distinct transverse circles of the second, external transmission surface, contained respectively in first transverse planes PLi situated at predetermined first levels Li along the axis (Z).

Each first curved sliding RF waveguide, associated specifically with an RF transmission channel Vi, is delimited in radial height or small side b between a first metal track and a second metal track of rank i of the first and second transmission surfaces, cut at their centre by a different transverse plane, in axial height or large side a in the longitudinal direction of the axis of symmetry (Z) between two first lateral containment and guidance walls spaced apart by said width a, and in length in the circumferential direction of the associated transverse circle between two first circumferential end walls disposed, for one, in proximity to the first associated RF access port and, for the other, in proximity to the first second associated RF access port, without one out of these two first end walls being interposed between said two first RF access ports.

According to FIG. 9 and a fourth embodiment of the invention, a hybrid of the second and third embodiments of FIGS. 7A-7B and 8A-8B, the RF rotating joint 402 is a rotating joint which comprises four RF transmission channels, two reception channels Rx 404, 406 and two transmission channels Tx 408, 410, with four input RF ports 414, 416, 418, 420, situated on the first, outer annular part 422 here forming a stator, and with four output RF ports 424, 426, 428, 430, situated on the second, inner cylindrical part 432 here forming a rotor, the four RF transmission channels 404, 406, 408, 410 being produced here using four first curved sliding RF waveguides, not visible in FIG. 9 and possibly wideband, two curved sliding waveguides dedicated to the two reception Rx RF transmission channels being distributed angularly over one and the same first first circumferential track at a first longitudinal level L1, and two curved sliding RF waveguides, dedicated to the two transmission Tx RF transmission channels being distributed angularly over one and the same second first circumferential track at a second longitudinal level L2.

Generally, a hybrid RF rotating joint according to the fourth embodiment, configured to connect to one another first and second parts of a rotary RF wave-guiding device, and to transmit RF electromagnetic signals between said first and second parts of said rotary device, comprises:

a first, outer part, of overall annular form, surrounding a cylindrical hole which is passed through by a longitudinal axis of cylindrical symmetry (Z); and a second, inner part, of cylindrical form, mounted in the cylindrical hole to revolve about the axis of rotation and of cylindrical symmetry (Z); and an integer number N, greater than or equal to 3, of distinct and separate transmission channels Vi between the first antenna part and the second part of the rotary device, i designating an index identifying the channel Vi lying between 1 and N.

The first, outer part comprises a first, electrically conductive, internal RF electromagnetic signal transmission surface, having a cylindrical form, defined by a first radius r1 equal to the radius of the cylindrical hole.

The second, inner part comprises a second, electrically conductive, external RF electromagnetic signal transmission surface, having a cylindrical form, defined by a second, external radius r2, strictly less than the first, internal radius r1, and rotationally mobile relative to the first internal transmission surface about the axis of symmetry (Z), according to an angle of angular displacement α, lying within a predetermined angular aperture range.

The first, internal transmission surface comprises N first RF access ports and first RF electromagnetic signal containment and guidance means, using meta-materials such as, for example, periodic structures of blocks with electrically-conductive surface.

The second, external transmission surface comprises N second RF access ports and second RF electromagnetic signal containment and guidance means, using meta-materials such as, for example, periodic structures of blocks with electrically-conductive surface.

The first and second transmission surfaces are configured by the first and second radii r1, r2, the geometry of the first and second access ports, and the geometry of the first and second RF containment and guidance means, such that:

each RF transmission channel Vi comprises a first associated distinct curved sliding RF waveguide, and the N first curved sliding RF waveguides are distributed longitudinally along the axis of symmetry (Z) according to at least two first distinct transverse circles Ck of the second transmission surface, contained respectively in first transverse planes PLk situated at first predetermined levels Lk along the axis (Z), k being an index greater than or equal to 2 and less than or equal to a number NC, strictly less than N; and at least two first curved sliding RF waveguides out of the N first rotating guides are distributed angularly along one and the same transverse circle of the second transmission surface, taken from among the NC first distinct transverse circles of the second transmission surface, contained respectively in the NC first transverse planes Plk situated at the first levels Lk.

Each first curved sliding RF waveguide, associated specifically with an RF transmission channel Vi, is delimited in radial height or small side b between a first metal track and a second metal track of rank i of the first and second transmission surfaces, cut at their centre by a different transverse plane, in axial height or large side a in the longitudinal direction of the axis of symmetry (Z) between two first lateral containment and guidance walls spaced apart by said width a, and in length in the circumferential direction of the associated transverse circle between two first circumferential end walls, disposed, for one, in proximity to the first associated RF access port and, for the other, in proximity to the first second associated RF access port, without one of these two first end walls being interposed between said two first RF access ports.

According to FIG. 10, the respective sizes and bulks of the RF rotating joint 402 according to the fourth embodiment of FIG. 9 and of a wideband RF rotating joint 502 having the described known structure of the second document cited and the same RF transmission requirements (i.e. same number of RF transmission channels, same frequency and bandwidth) and of angular travel as those of the RF rotating joint 402, are compared. It clearly emerges that the RF rotating joint 402 according to the invention has a lesser bulk than that of the conventional RF rotating joint 502.

According to FIG. 11A, a first relative angular position 492 of the second cylindrical part, here forming a rotor, relative to the first, annular part, here forming a stator, of the RF rotating joint 402 of FIG. 10, corresponds to an extreme angular travel in a direction of rotation, here the clockwise direction in FIG. 11A.

According to FIG. 11B, a second relative angular position 494 of the RF rotating joint 402 of FIG. 10, i.e. of the second, cylindrical part relative to the first, annular part, corresponds to a neutral or reference position in which the angular travel is zero.

According to FIG. 11C, a third relative angular position 496 of the RF rotating joint 402 of FIG. 9, i.e. of the second, cylindrical part relative to the first, annular part, corresponds to an extreme angular travel in the other direction of rotation, here the counterclockwise direction in FIG. 11C.

According to FIGS. 9, 11A, 11B and 11C, the two RF ports for external connection to a mobile part of the antenna, disposed here inside the central hole of the first, annular part, belong and are fixed to the rotor-forming second, cylindrical part. It is recalled here that the second part, of external cylindrical form, is provided with blocks forming lateral or end walls to contain and guide the electromagnetic waves in the joint, and that the external cylindrical surface of extension of the top faces of the blocks has a radius less than the internal radius r1 of the internal transmission surface of the first, annular face, here forming a stator. Thus, the opening formed between the first and second transmission surfaces allows the rotor-forming second part to slide and pivot inside the stator-forming, first annular part, and makes it possible to produce curved sliding RF waveguides without contact for transmitting the electromagnetic waves while the joint rotates.

It should be noted that, in accordance with the proposed generalization of the fourth embodiment of the joint, it is possible to modify the geometry of the joint as a function of the angular travel range requirements. For example, if the desired angle of travel is more reduced, it is possible to place three RF transmission channels instead of two without necessarily changing the internal diameter of the ring or bushing of the first, annular part. Otherwise, by reasonably increasing the internal diameter of the ring, it is possible to envisage housing 4, 6, even more RF access ports inside the first and second parts, which makes it possible to transmit 4, 6 or more RF transmission channels in a single RF rotating joint, for example in the case of a geostationary application with an angular travel range equal to ±9°.

According to FIGS. 12A, 12B and 12C, and a fifth embodiment, derived from the RF rotating joint 2 of the first embodiment of FIGS. 1A and 1B, a radiofrequency RF rotating joint 502 according to the invention here comprises a single RF transmission channel 504.

The radiofrequency RF rotating joint 502 is configured here to mechanically connect to one another first and second parts of a rotary RF wave-guiding device, for example of a rotary RF antenna, and to transmit RF electromagnetic signals over a single RF transmission channel V1 504 between said first and second parts of said rotary RF device.

The radiofrequency RF rotating joint 502 comprises:

- a first, outer part 512, of overall annular form, surrounding a cylindrical hole 514 which is passed through by a longitudinal axis of cylindrical symmetry 516 (Z), and a second, inner part 518, of cylindrical form, mounted in the cylindrical hole 514, to revolve about the axis of rotation and of cylindrical symmetry 516 (Z); and
- a third, outer part 520, of overall annular form, mounted side-by-side with the first, outer cylindrical part along the longitudinal axis of cylindrical symmetry 516 (Z) by being blocked in translation along said axis (Z), mounted to rotate freely with the first part, and mounted to rotate freely to revolve about the second part.

The first, outer part 512 comprises a first, electrically conductive, internal RF electromagnetic signal transmission surface 522, situated at a first level L1 along the longitudinal axis L1 and having a cylindrical form, defined by a first, internal radius r1, equal to the radius of the cylindrical hole 514.

The second, inner part 518 comprises a second, electrically conductive, external RF electromagnetic signal transmission surface 528, situated at the first level L1 along the longitudinal axis (Z) and having a cylindrical form, defined by a second, external radius r2, strictly less than the first, internal radius r1, and facing and rotationally mobile with respect to the first, internal transmission surface 522, and a third, electrically conductive, external RF electromagnetic signal transmission surface 530, situated at a second level L2 along the longitudinal axis L2 and having a cylindrical form, defined by a third, external radius r3.

The third, outer part 520, comprises a fourth, electrically conductive, internal RF electromagnetic signal transmission surface 532, situated at the second level L2 along the longitudinal axis (Z) and having a cylindrical form, defined by a fourth, internal radius r4, strictly greater than the third, external radius r3, and facing and rotationally mobile with respect to the third, external surface 530, and mobile about the axis of symmetry (Z), according to an angle of angular displacement $\alpha$, lying within a predetermined angular aperture range 534.

The first, internal transmission surface 522 here comprises a first RF access port 542 and first, meta-material-based, RF electromagnetic signal containment and guidance means 544.

The second, external transmission surface 528 here comprises a second RF access port 546 and second, meta-material-based, RF electromagnetic signal containment and guidance means 548.

The third, external transmission surface 530 here comprises a single third RF access port 550 and third, meta-material-based, RF electromagnetic signal containment and guidance means 552.

The fourth, internal transmission surface 532 here comprises a single fourth RF access port 554 and fourth, meta-material-based, RF electromagnetic signal containment and guidance means 556.

The first, second, third and fourth RF transmission surfaces 522, 528, 530, 532 are configured by the first, second, third and fourth radii r1, r2, r3, r4, the geometry of the first, second, third and fourth RF access ports and the geometry of the first, second, third and fourth RF containment and guidance means 540, 548, 552, 556, such that:

- the single transmission channel V1 504 comprises a first curved sliding RF waveguide between the first, outer part and the second, inner part, and a second, wideband curved sliding RF waveguide between the second, inner part and the third, outer part, the first and second curved sliding RF waveguides being respectively disposed along two transverse circles of the second and third transmission surfaces and being linked in series to one another.

According to FIGS. 12A, 12B and 12C, the first curved sliding RF waveguide is delimited in radial height or small side b between a first metal track and a second metal track of the first and second metal surfaces, in axial height or large side a in the longitudinal direction of the axis of symmetry (Z) between two lateral transverse containment and guidance walls spaced apart by said width a on either side of the transverse circle situated in the transverse plane having a first predetermined level, and in length in the circumferential direction between a first circumferential end wall and a second circumferential end wall, disposed respectively in proximity to the first RF access port and to the second RF access port.

According to FIGS. 12A, 12B and 12C, the second curved sliding RF waveguide is delimited in radial height or small side b between a third metal track and a fourth metal track of the third and fourth transmission surfaces, in width or large side a in the longitudinal direction of the axis of symmetry (Z) between two lateral containment and guidance walls spaced apart by said width a, and in length in the circumferential direction between a first circumferential end wall and a second circumferential end wall, disposed respectively in proximity to the first RF access port and to the second RF access port.

Here, particularly in FIGS. 12A-12C, the external radii r1 and r4 are equal and the internal radii r2 and r3 are equal.

Generally, an RF rotating joint according to the fifth embodiment, configured to connect to one another first and second parts of a rotary RF wave-guiding device, and to transmit RF electromagnetic signals between said first and second parts of a rotary RF device, comprises:

- a first, outer part, of overall annular form, surrounding a cylindrical hole which is passed through by a longitudinal axis of cylindrical symmetry (Z), and
- a second, inner part, of cylindrical form, mounted in the cylindrical hole, to revolve about the axis of rotation and of cylindrical symmetry (Z); and
- a third, outer part, of overall annular form, mounted side-by-side with the first, outer part along the longitudinal axis of cylindrical symmetry (Z) by being blocked in translation along said axis (Z), mounted to rotate freely with the first part, and mounted to rotate freely to revolve about the second part; and
- an integer number N, greater than or equal to 1, of distinct and separate RF transmission channels Vi, between the first antenna part and the second part of the rotary RF device, i designating an index identifying the RF channels Vi varying between 1 and N.

The first, outer part comprises a first, electrically conductive, internal RF electromagnetic signal transmission surface, situated at a first level L1 along the longitudinal axis L1 and having a cylindrical form, defined by a first, internal radius r1, equal to the radius of the cylindrical hole.

The second, inner part comprises a second, electrically conductive, external RF electromagnetic signal transmission surface, situated at the first level L1 along the longitudinal axis (Z) and having a cylindrical form, defined by a second, external radius r2, strictly less than the first, internal radius r1, facing and rotationally mobile with respect to the first, internal transmission surface, and a third, metallic, external RF electromagnetic signal transmission surface, situated at a second level L2 along the longitudinal axis L2 and having a cylindrical form, defined by a third, external radius r3.

The third, outer part comprises a fourth, electrically conductive, internal RF electromagnetic signal transmission surface, situated at the second level L2 along the longitudinal axis (Z) and having a cylindrical form, defined by a fourth, internal radius r4, strictly greater than the third, external radius r3, facing and rotationally mobile with respect to the third, external surface 530, and mobile about the axis of symmetry (Z) according to an angle of angular displacement $\alpha$, lying within a predetermined internal angular aperture range 534.

The first transmission surface comprises N first RF access ports and first RF electromagnetic signal containment and guidance means.

The second, external transmission surface comprises N second RF access ports and second RF electromagnetic signal containment and guidance means.

The third, external transmission surface comprises N third RF access ports and third RF electromagnetic signal containment and guidance means.

The fourth, internal transmission surface comprises N fourth RF access ports and fourth RF electromagnetic signal containment and guidance means.

The first, second, third and fourth RF transmission surfaces are configured by the first, second, third and fourth radii r1, r2, r3, r4, the geometry of the first, second, third and fourth RF access ports and the geometry of the first, second, third and fourth RF containment and guidance means, such that:

- each RF transmission channel Vi, i varying from 1 to N, comprises, connected in series, a first curved sliding RF waveguide between the first, outer part and the second, inner part, and a second curved sliding RF waveguide between the second, inner part and the third, outer part; and
- the first and second curved sliding RF waveguides of each transmission channel Vi, i varying from 1 to N, are respectively disposed along two, first and second transverse circles corresponding to the index i identifying the transmission channel Vi, the first transverse circles being disposed on the second RF transmission surface and distributed longitudinally along the axis of symmetry (Z) at predetermined distinct first levels L1*i*, and the second transverse circles being disposed on the third RF transmission surface and distributed longitudinally along the axis of symmetry (Z) at predetermined distinct first levels.

The first curved sliding RF waveguide of each RF transmission channel Vi, i varying from 1 to N, is delimited in radial height or small side b between a first metal track and a second metal track of the first and second RF transmission surfaces, in axial height or large side a in the longitudinal direction of the axis of symmetry (Z) between two lateral transverse containment and guidance walls spaced apart by said width a on either side of the first transverse circle situated at the first predetermined level L1*i*, and in length in the circumferential direction between a first circumferential end wall and a second circumferential end wall, disposed respectively in proximity to the first RF access port and to the second RF access port.

The second curved sliding RF waveguide of each RF transmission channel Vi, i varying from 1 to N, is delimited in radial height or small side b between a third metal track and a fourth metal track of the third and fourth RF transmission surfaces, in axial height or large side a in the longitudinal direction of the axis of symmetry (Z) between two transverse lateral containment and guidance walls spaced apart by said width a on either side of the second transverse circle situated at the second predetermined level L2*i*, and in length in the circumferential direction between a first circumferential end wall and a second circumferential end wall, disposed respectively in proximity to the first RF access port and to the second RF access port.

Generally and independently of the embodiment of the rotating joint according to the invention, the first, outer part comprises N first external channel connection RF terminals, connected respectively one-to-one to the N first RF access ports of the corresponding N first curved sliding RF waveguides of the first RF transmission surface through N first distinct corresponding transition links, passing through the first, outer part.

According to the first, second, third and fourth embodiments of the RF rotating joint according to the invention, the second, inner part comprises N second external channel connection RF terminals, connected respectively one-to-one to the N second RF access ports of the corresponding first curved sliding RF waveguides of the second RF transmission surface through N distinct corresponding second transition links which pass longitudinally through the second, inner part.

The N second external connection RF terminals of the second, inner part are disposed and distributed on one side on one of the first and second foot and end faces of the cylinder forming the second, inner part, or on both sides on the first face and the second foot and end face of the cylinder forming the second, inner part.

According to the first, second, third and fourth embodiments of the RF rotating joint according to the invention, the first, outer part and the second, inner part can be, respectively, a stator and a rotor or can be, reciprocally, a rotor and a stator.

According to the fifth embodiment of the RF rotating joint according to the invention, the third, outer part comprises N second external RF transmission channel connection RF terminals, connected respectively one-to-one to the N fourth RF access ports of the N corresponding second curved sliding RF waveguides of the fourth RF transmission surface through N second distinct corresponding transition links, passing through the third, outer part.

According to the fifth embodiment of the RF rotating joint according to the invention, the first, outer part and the third, outer part can be, respectively, a stator and a rotor or can be, reciprocally, a rotor and a stator.

More generally, the cylindrical forms of the first, second, and/or of the third, fourth transmission surfaces of the RF rotating joints of the invention described above can be generalized to forms of surfaces of revolution about the axis of symmetry (Z) each formed by a succession of sections of surfaces of revolution about the longitudinal axis (Z) forming circumferential tracks at different axial levels that can have different or equal radii.

More generally, a radiofrequency RF rotating joint according to the invention is configured to mechanically and radio-electrically connect to one another first and second parts of a rotary RF wave-guiding device, and to transmit RF electromagnetic signals between said first and second parts of said rotary RF wave-guiding device.

The RF rotating joint according to the invention comprises:

a first, outer part, of overall annular form, having a first, electrically conductive, internal electromagnetic signal transmission surface, with symmetry of revolution over an angular interval of extension of non-zero length and less than or equal to 360 degrees about a longitudinal axis of rotation (Z); and a second part, inside the first part, having a first, electrically conductive, external electromagnetic signal transmission surface, with symmetry of revolution over the angular interval of extension about the longitudinal axis (Z), disposed without mechanical contact facing the first, internal surface and rotationally mobile about the longitudinal axis (Z) over a predetermined interval of angular rotation; and an integer number N, greater than or equal to 1, of distinct RF transmission channel(s) Vi, i varying from 1 to N, between the first part and the second part of the rotary RF wave-guiding device.

The first, internal electromagnetic signal transmission surface comprises a succession of a predetermined number NC, greater than or equal to 1 and less than or equal to N, of first sections of surfaces of revolution about the axis (Z) situated at different first levels L1(*k*), k varying from 1 to NC, along the longitudinal axis of symmetry (Z) about associated first internal average radii r1(*k*), k varying from 1 to NC, and comprises N first RF access ports and first, meta-material-based, RF electromagnetic signal containment and guidance means.

The second, external RF electromagnetic signal transmission surface comprises a succession of NC second sections of surfaces of revolution about the axis (Z), situated respectively at the different first levels L1(*k*), k varying from 1 to NC, along the longitudinal axis of symmetry (Z) about associated second external average radii r2(*k*), k varying from 1 to NC, strictly less than the corresponding first internal average radii r1(*k*), and comprises N second RF access ports and second, meta-material-based, RF electromagnetic signal containment and guidance means.

The first and second RF transmission surfaces are configured by the first and second average radii r1(*k*), r2(*k*), the first longitudinal levels L1(*k*), k varying from 1 to NC, the geometry of the first and second RF access ports, and the geometry of the first and second RF containment and guidance means, such that:

each RF transmission channel Vi, i varying from 1 to N, comprises a different first curved sliding waveguide, and the N first curved sliding RF waveguides are distributed angularly over the NC first sections of surfaces of revolution about the axis (Z), each of the NC sections of surfaces of revolution about the longitudinal axis (Z) being situated along the longitudinal axis of symmetry (Z) at its associated first level L1(*k*), k varying from 1 to NC.

Each first curved sliding waveguide, associated with an RF transmission channel Vi, i varying from 1 to N, is delimited:

in radial height or small side $b_k$ between a first section of surface of revolution and a second section of surface of revolution about the facing axis (Z) of rank k of the first and second transmission surfaces, k lying between 1 and NC, in axial height or large side $a_k$ between the two first lateral containment and guidance walls of the first and second sections of surfaces of revolution about the axis (Z) of rank k, and in length between two first circumferential containment and guidance end walls, disposed, for one, in proximity to the associated first RF access port and, for the other, in proximity to the associated second RF access port, without one of these two first circumferential end walls being interposed between said two first RF access ports.

Generally, the rotational guidance of the rotor-forming part relative to the stator-forming part can be produced with at least one electric motor, preferably an electric stepper motor.

The electric stepper motor makes it possible to select one angular position with respect to another without using external telemetry.

Generally, the material used to contain and guide the RF electromagnetic waves is an electrical conductor, for example a metal, and the electrical insulation used inside the waveguide or guides is a vacuum or air.

An RF rotating joint according to the invention as described above is produced by using at least one of the following production methods:

conventional machining by milling, 3D printing, metallized plastic moulding or metal casting, electroforming.

The electrical transmission power, allowed by an RF rotating joint according to the invention as described above, is compatible with terrestrial or ground applications and space applications, embedded onboard a satellite.

Advantageously, the RF rotating joint according to the invention described above in the various embodiments, is a compact joint, without contact, with very good RF performance levels both in terms of insertion losses and in terms of decoupling between the transmission channels.

Thus, it has been shown that a typical use of the RF rotating joint according to the invention is that of an RF rotating joint with four RF transmission channels, two channels in transmission Tx band and two channels in reception Rx band, operating in wideband mode (typically 2.5 GHz band). A use with a greater number of channels applicable to multi-spot or antenna multi-beam configurations has also been described.

In the case of the generalization of the fifth embodiment of the RF rotating joint of FIGS. 12A to 12C, the second, inner part further comprises a third, electrically conductive, external RF electromagnetic signal transmission surface, with symmetry of revolution about the longitudinal axis (Z) over the angular interval of extension. Furthermore, the third, outer part comprises a fourth, electrically conductive, internal RF electromagnetic signal transmission surface, with symmetry of revolution about the longitudinal axis (Z) over the angular interval of extension, disposed without mechanical contact facing the third, external surface and mobile about the longitudinal axis (Z) over the predetermined interval of angular rotation.

The third, outer RF transmission surface comprises a succession of NC third sections of surfaces of revolution about the axis (Z), situated at different second levels L2($k$), k varying from 1 to NC, along the longitudinal axis of symmetry (Z) about associated third external average radii r3($k$), k varying from 1 to NC, and comprises N third RF access ports and third, meta-material-based, RF electromagnetic signal containment and guidance means.

The fourth, internal RF transmission surface comprises a succession of NC fourth sections of surfaces of revolution about the longitudinal axis (Z), situated respectively at the different second levels L2($k$), k varying from 1 to NC, along the longitudinal axis (Z) about associated fourth internal average radii r4($k$), k varying from 1 to NC, strictly less than the corresponding third external average radii r3($k$), and comprises N fourth RF access ports and fourth, meta-material-based, RF electromagnetic signal containment and guidance means.

The first, second, third and fourth RF transmission surfaces are configured by the first, second, third and fourth average radii r1($k$), r2($k$), r3($k$), r4($k$), the first and second longitudinal levels L1($k$), L2($k$), k varying from 1 to NC, the geometry of the first, second, third and fourth RF access ports and the geometry of the first, second, third and fourth RF containment and guidance means, such that:

each RF transmission channel Vi, i varying from 1 to N, comprises, connected in series, a first curved sliding RF waveguide between the first, outer part and the second, inner part, and a second curved sliding RF waveguide between the second, inner part and the third, outer part; and the N first and second curved sliding RF waveguides of each transmission channel Vi, i varying from 1 to N, are different, disposed orthogonally to the axis of symmetry (Z), distributed angularly and respectively over the NC second and third sections of surfaces of revolution of the second, external surface and of the third external surface, the second and third sections of surfaces of revolution about the longitudinal axis (Z) of the first and second waveguides of each channel Vi being paired with one another, having one and the same index k(i) of rank of the second and third sections on the second and third transmission surfaces and being situated along the longitudinal axis (Z) at their associated levels L1$k(i)$, L2$k(i)$.

The invention claimed is:

1. A radiofrequency RF rotating joint for radio-electrically connecting together first and second parts of a rotary RF wave-guiding device, and for transmitting RF electromagnetic signals between said first and second parts of said rotary RF wave-guiding device, the RF rotating joint comprising:

a first, outer part, of overall annular form, having a first, internal, electrically conductive, electromagnetic signal transmission surface, with symmetry of revolution over an angular interval of extension of a length that is non-zero and less than or equal to 360 degrees about a longitudinal axis of rotation (Z); and a second part, internal to the first part, having a second, external, electrically conductive, electromagnetic signal transmission surface, with axis of revolution over an angular interval of extension about the longitudinal axis (Z), disposed without mechanical contact facing the first, internal surface, and rotationally mobile about the longitudinal axis (Z) over a predetermined interval of angular rotation; and an integer number N, greater than or equal to 1, of distinct RF transmission channel(s) Vi, i varying from 1 to N, between the first part and the second part of the rotary RF wave-guiding device;

the first, internal, electromagnetic signal transmission surface comprising a succession of a predetermined number NC, greater than or equal to 1 and less than or equal to N, of first sections of surfaces of revolution about the axis (Z), situated at different first levels L1($k$), k varying from 1 to NC, along the longitudinal axis of symmetry (Z) about an associated first internal average radii r1($k$), k varying from 1 to NC, and comprising N first RF access ports and first, meta-material-based, RF electromagnetic signal containment and guidance means; and the second, external, RF electromagnetic signal transmission surface comprising a succession of NC second sections of surfaces of revolution about the axis (Z), situated at the different first levels L1(*k*), k varying from 1 to NC, along the longitudinal axis of symmetry (Z) about associated second external average radii r2(*k*), k varying from 1 to NC, strictly less than the corresponding first, internal, average radii r1(*k*), and comprising N second RF access ports and second meta-material-based, RF electromagnetic signal containment and guidance means; and the first and second RF transmission surfaces being configured by the first and second average radii r1(*k*), r2(*k*), the first levels L1(*k*), k varying from 1 to NC, the geometry of the first and second RF access ports, and the geometry of the first and second RF containment and guidance means, such that:

each RF transmission channel Vi, i varying from 1 to N, comprises a first different curved sliding RF waveguide, and the N first curved sliding RF waveguides are distributed angularly over the NC first sections of surfaces of revolution about the axis (Z), each of the first and second NC sections of surfaces of revolution about the axis (Z) being situated along the longitudinal axis of symmetry (Z) at its associated first level L1(*k*), k varying from 1 to NC.

2. The radiofrequency RF rotating joint according to claim 1, wherein:

each first curved sliding RF waveguide, associated with the RF transmission channel Vi, i varying from 1 to N, is delimited:

in radial height or small side $b_k$ between the first section of surface of revolution and the second section of surface of revolution about the axis (Z) of rank k of the first and second transmission surfaces, k lying between 1 and NC, in axial height or large side $a_k$ between two first lateral containment and guidance walls of the first and second sections of surfaces of revolution about the axis (Z) of rank k, and in length between a first circumferential end containment and guidance wall relating to the first, meta-material-based, RF electromagnetic signal containment and guidance means and a second circumferential end containment and guidance wall relating to the second, meta-material-based, RF electromagnetic signal containment and guidance means, disposed, for one, in proximity to the first associated RF access port and, for the other, in proximity to the second associated RF access port, without one of the first and second circumferential end containment and guidance walls being interposed between said first and second RF access ports.

3. The RF rotating joint according to claim 2, wherein:

the two first lateral containment and guidance walls of each first curved sliding waveguide are each formed by a one-or two-dimensional network of blocks with electrically-conductive surface;

the blocks of the two lateral walls of each first curved sliding waveguide are slender and protrude from one and the same electrically-conductive circumferential surface of the first curved sliding RF waveguide, or from the two electrically-conductive circumferential surfaces of the first curved sliding RF waveguide with one lateral wall per circumferential surface, or by interleaving of the blocks from the two electrically-conductive circumferential surfaces for at least one lateral wall taken from among the two lateral walls.

4. The RF rotating joint according to claim 2, wherein:

the first and second circumferential end containment and guidance walls of each first curved sliding RF waveguide are disposed on either side of the first and second RF access ports; and the two containment and guidance circumferential end walls are each formed by a one-or two-dimensional network of blocks with electrically-conductive surface, and the blocks of the two circumferential end walls are slender and protrude respectively from the first transmission surface for the first end wall associated with and disposed in the vicinity of the first RF access port and from the second transmission surface for the second end wall associated with and disposed in the vicinity of the second RF access port.

5. The RF rotating joint according to claim 4, wherein the blocks of the end walls of the RF transmission channel or of several RF transmission channels situated at one and the same longitudinal level are formed by circumferential lines of blocks arranged combwise so as to allow a free mechanical crossing of the first and second end walls when the first and second parts rotate relative to one another while ensuring their electromagnetic wave containment function.

6. The radiofrequency RF rotating joint according to claim 1, wherein the integer number N of RF transmission channels is equal to 1, and wherein the single RF transmission channel V1 comprises one of the N first curved sliding RF waveguides, disposed orthogonally to the longitudinal axis (Z) of symmetry at one of the different first levels L1(*k*).

7. The radiofrequency RF rotating joint according to claim 1, wherein:

the integer number N of distinct RF transmission channels Vi is greater than or equal to 2, and each RF transmission channel Vi, i varying from 1 to N, comprises one of the N first curved sliding RF waveguides, and the N first curved sliding RF waveguides are distributed angularly along one and the same transverse circle, disposed orthogonally to the longitudinal axis of symmetry at one of the different first levels L1(*k*).

8. The radiofrequency RF rotating joint according to claim 1, wherein:

the integer number N, of distinct RF transmission channels Vi is greater than or equal to 2, and each RF transmission channel Vi, i varying from 1 to N, comprises one of the N first curved sliding RF waveguides, and the N first curved sliding RF waveguides are distributed longitudinally along the axis of symmetry (Z) at the different first levels L1(*k*).

9. The radiofrequency RF rotating joint according to claim 1, wherein:

the integer number N of distinct RF transmission channels Vi is greater than or equal to 3, and each RF transmission channel Vi, i varying from 1 to N, comprises one of the N first curved sliding RF waveguides, and the N first curved sliding RF waveguides are distributed longitudinally along the axis of symmetry (Z) at a number NC of first levels greater than or equal to 2 and strictly less than N; and at least two first curved sliding RF waveguides out of the N first rotating guides are disposed orthogonally to the axis of symmetry (Z) at one and the same predetermined level and each delimited by a corresponding angular sector.

10. The radiofrequency RF rotating joint according to claim 1, further comprising a third, outer part, of overall annular form, mounted side-by-side with the first, annular outer part along the longitudinal axis of symmetry (Z) while being blocked in translation along said axis (Z), and free to rotate with the first, outer part to rotate about the second, inner part (518); and wherein the second, inner part further comprises a third, electrically conductive, outer RF electromagnetic signal transmission surface, with symmetry of revolution about the longitudinal axis (Z) over the angular interval of extension; and the third, outer part comprises a fourth, electrically conductive, internal RF electromagnetic signal transmission surface, with symmetry of revolution about the longitudinal axis (Z) over the angular interval of extension, disposed without mechanical contact facing the third, outer surface and mobile about the longitudinal axis (Z) over the predetermined interval of angular rotation; and the third, outer RF transmission surface comprises a succession of NC third sections of surfaces of revolution about the axis (Z), situated at different second levels L2(*k*), k varying from 1 to NC, along the longitudinal axis of symmetry (Z) about associated third outer average radii r3(*k*), k varying from 1 to NC, and comprising N third RF access ports and third, meta-material-based, RF electromagnetic signal containment and guidance means; and the fourth, internal RF transmission surface comprises a succession of NC fourth sections of surfaces of revolution about the longitudinal axis (Z), situated respectively at the different second levels L2(*k*), k varying from 1 to NC, along the longitudinal axis (Z) about associated fourth internal average radii r4(*k*), k varying from 1 to NC, strictly less than the corresponding third external average radii r3(*k*), and comprises N fourth RF access ports and fourth, meta-material-based, RF electromagnetic signal containment and guidance means; and the first, second, third and fourth RF transmission surfaces are configured by the first, second, third and fourth average radii r1(*k*), r2(*k*), r3(*k*), r4(*k*), the different first levels L1(*k*) and the second longitudinal levels L2(*k*), the geometry of the first, second, third and fourth RF access ports and the geometry of the first, second, third and fourth RF containment and guidance means, such that:

each RF transmission channel Vi, i varying from 1 to N, comprises, connected in series, one of the N first curved sliding RF waveguides called a first curved sliding RF waveguide between the first, outer part and the second, inner part, and another one of the N first curved sliding RF waveguides called a second curved sliding RF waveguide between the second, inner part and the third, outer part; and the N first and second curved sliding RF waveguides of each transmission channel Vi, i varying from 1 to N, being different, disposed orthogonally to the axis of symmetry (Z), distributed angularly and respectively over the NC second and third sections of the surface of revolution of the second, outer surface and of the third, outer surface, the second and third sections of surfaces of revolution about the longitudinal axis (Z) of the first and second waveguides of each channel Vi being paired with one another, having one and the same index k(i) of second and third sections on the second and third surfaces and being situated along the longitudinal axis (Z) at associated levels L1*k*(i), L2*k*(i).

11. The RF rotating joint according to claim 10, wherein:

the third, outer part comprises N second external RF transmission channel connection RF terminals, connected respectively one-to-one to the N fourth RF access ports of the N second corresponding curved sliding RF waveguides of the fourth RF transmission surface through N second distinct corresponding transition links, passing through the third, outer part, and the N second access ports of the first curved sliding waveguides are connected one-to-one by unitary transmission channel to the N third access ports of the second curved sliding waveguides.

12. The RF rotating joint according to claim 11, wherein the first, outer part and the third, outer part are respectively a stator and a rotor or are of respectively, reciprocally, a rotor and a stator.

13. The RF rotating joint according to claim 1, wherein the first, outer part comprises N first external channel connection RF terminals, connected respectively one-to-one to the N first RF access ports of the N first corresponding curved sliding RF waveguides of the first RF transmission surface through N first distinct corresponding transition links, passing through the first, outer part.

14. The RF rotating joint according to claim 1, wherein the second, inner part comprises N second external RF transmission channel connection RF terminals, connected respectively one-to-one to the N second RF access ports of the first corresponding curved sliding RF waveguides of the second RF transmission surface through N second distinct corresponding transition links which longitudinally and internally pass through the second, inner part.

15. The RF rotating joint according to claim 14, wherein the first, outer part and the second, inner part are respectively a stator and a rotor or are respectively, reciprocally, a rotor and a stator.

16. The RF rotating joint according to claim 1, wherein

RF electromagnetic signal containment and guidance means taken from among the first and second RF electromagnetic signal containment and guidance means are divided between the N first curved sliding RF waveguides that are circumferentially or laterally adjacent.

17. The RF rotating joint according to claim 1, wherein the first, internal average radii r1(*k*) and the second, external average radii r2(*k*), k varying from 1 to NC, are respectively equal to a first constant r1 and to a second constant r2.

18. The RF rotating joint according to claim 1, wherein:

the number NC of sections of the first transmission surface, respectively sections of the second transmission surface, is greater than or equal to 2, and at least two sections of the first transmission surface have different first, internal radii; and the at least two sections of the second transmission surface, associated facing one another, have different second, external radii.

19. The radiofrequency RF rotating joint according to claim 1, wherein:

the NC first sections of surfaces of revolution about the axis (Z) are cylindrical sections about the axis (Z), situated at different first levels L1(*k*), k varying from 1 to NC, along the longitudinal axis of symmetry (Z) and associated with first, internal radii r1(*k*), k varying from 1 to NC; and the NC second sections of surfaces of revolution about the axis (Z) are cylindrical sections about the axis (Z), situated respectively at different first levels L1(*k*), k varying from 1 to NC, along the longitudinal axis of symmetry (Z) and associated with second, external radii r2(*k*), k varying from 1 to NC; and/or the NC third sections of surfaces of revolution about the axis (Z) are cylindrical sections about the axis (Z), situated at different second levels L2(*k*), k varying from 1 to NC, along the longitudinal axis of symmetry (Z) and associated with third, external radii r3(*k*), k varying from 1 to NC; and the NC fourth sections of surfaces of revolution about the axis (Z) are cylindrical sections about the axis (Z), situated respectively at different second levels L2(*k*), k varying from 1 to NC, along the longitudinal axis of symmetry (Z) and associated with fourth internal radii r4(*k*), k varying from 1 to NC.

20. A rotary RF wave-guiding device comprising:

a first part;

a second part that is rotary relative to the first part; and an RF rotating joint according to claim 1, intended to connect the first and second parts of said rotary device and to transmit electromagnetic signals between the first and second parts.

* * * * *